US010677111B2

(12) United States Patent
Nakhle et al.

(10) Patent No.: US 10,677,111 B2
(45) Date of Patent: Jun. 9, 2020

(54) VARIABLE DISPLACEMENT ENGINE INCLUDING DIFFERENT CAM LOBE PROFILES

(71) Applicant: Ford Global Technologies, LLC, Dearborn, MI (US)

(72) Inventors: Danny Nakhle, Windsor (CA); Kevin Shinners, Livonia, MI (US); Robert Stephen Furby, Novi, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 303 days.

(21) Appl. No.: 15/717,850

(22) Filed: Sep. 27, 2017

(65) Prior Publication Data

US 2019/0093525 A1 Mar. 28, 2019

(51) Int. Cl.

| | |
|---|---|
| ***F01L 13/00*** | (2006.01) |
| ***F01L 1/24*** | (2006.01) |
| ***F01L 1/047*** | (2006.01) |
| ***F01L 1/08*** | (2006.01) |
| ***F01L 1/18*** | (2006.01) |
| ***F01L 1/14*** | (2006.01) |
| ***F01L 1/053*** | (2006.01) |
| ***F01L 1/20*** | (2006.01) |
| ***F02B 73/00*** | (2006.01) |

(52) U.S. Cl.

CPC ..... *F01L 13/0005* (2013.01); *F01L 1/047* (2013.01); *F01L 1/08* (2013.01); *F01L 1/24* (2013.01); *F01L 1/14* (2013.01); *F01L 1/18* (2013.01); *F01L 1/20* (2013.01); *F01L 2001/0537* (2013.01); *F01L 2001/186* (2013.01); *F01L 2013/001* (2013.01); *F01L 2105/00* (2013.01); *F01L 2250/02* (2013.01); *F01L 2250/04* (2013.01); *F01L 2800/08* (2013.01); *F02B 73/00* (2013.01)

(58) Field of Classification Search

CPC ..... F01L 1/047; F01L 1/08; F01L 1/18; F01L 1/20; F01L 13/0005; F01L 2013/001

See application file for complete search history.

(56) References Cited

U.S. PATENT DOCUMENTS

| | | | | |
|---|---|---|---|---|
| 4,633,403 | A | 12/1986 | Asmus | |
| 6,513,471 | B1 | 2/2003 | Hicks | |
| 7,296,549 | B1 | 11/2007 | Sailer et al. | |
| 7,322,329 | B2 | 1/2008 | Hendriksma et al. | |
| 7,490,001 | B2 | 2/2009 | Izelfanane | |
| 8,327,619 | B2 | 12/2012 | Persson | |
| 2001/0017114 | A1* | 8/2001 | Mikame | F01L 1/34 123/90.15 |
| 2004/0031458 | A1* | 2/2004 | Snyder | F01B 1/12 123/90.31 |
| 2014/0137819 | A1* | 5/2014 | McConville | F01L 13/0036 123/90.6 |

(Continued)

*Primary Examiner* — Sizo B Vilakazi
*Assistant Examiner* — Anthony L Bacon
(74) *Attorney, Agent, or Firm* — Geoffrey Brumbaugh; McCoy Russell LLP

(57) ABSTRACT

Methods and systems are provided for an engine including cams having different lobe profiles. In one example, cams of a first cam group drive a plurality of deactivatable cylinder valves and cams of a second cam group drive a plurality of non-deactivatable cylinder valves. The cams of the first cam group include a different lobe profile relative to cams of the second cam group.

18 Claims, 6 Drawing Sheets

(56) References Cited

U.S. PATENT DOCUMENTS

| | | | | |
|---|---|---|---|---|
| 2015/0159521 | A1* | 6/2015 | Baltrucki | F01L 1/18 123/90.12 |
| 2015/0267574 | A1 | 9/2015 | Radulescu et al. | |
| 2018/0023424 | A1* | 1/2018 | McCarthy, Jr. | F01L 1/2405 123/90.15 |
| 2019/0010839 | A1* | 1/2019 | Tsunoda | F01L 13/00 |

* cited by examiner

VARIABLE DISPLACEMENT ENGINE INCLUDING DIFFERENT CAM LOBE PROFILES

FIELD

The present description relates generally to methods and systems for an internal combustion engine including cams having different lobe profiles.

BACKGROUND/SUMMARY

Internal combustion engines may be configured to operate with a variable number of active or deactivated cylinders to increase fuel economy, while optionally maintaining the overall exhaust mixture air-fuel ratio about stoichiometry. This operation may be referred to as VDE (variable displacement engine) operation. In some examples, a portion of an engine's cylinders may be disabled during selected conditions, where the selected conditions can be defined by parameters such as engine speed and/or load thresholds, as well as various other operating conditions such as vehicle speed. A control system may enable and/or disable selected cylinders through adjustment of a plurality of cylinder valve deactivators that affect the operation of the cylinder's intake and exhaust valves.

Each cylinder valve deactivator may be a rolling finger follower of a deactivatable valve assembly, with each rolling finger follower being switchable from an activated mode to a deactivated mode (and vice versa). During conditions in which a rolling finger follower is in the activated mode, an outer arm of the roller finger follower is driven by rotation of a cam of a camshaft to move a poppet valve, with the movement of the poppet valve controlling intake of gases into a combustion chamber of the engine or controlling flow of exhaust gases out of the combustion chamber. In the deactivated mode, the outer arm is not driven by the cam so that the rotational motion of the cam is not translated to the poppet valve, thereby resulting in a lost motion.

However, the rolling finger followers of the deactivatable valve assembly are often produced with inherent nominal lash and lash maximum wear characteristics that are different than non-deactivatable rolling finger followers. These characteristics may result in different amounts of lift and/or a different lift timing of poppet valves being driven by the deactivatable rolling finger followers. One example approach to address these issues is shown by Hendriksma et al. in U.S. Pat. No. 7,322,329. Therein, a valve-deactivation roller hydraulic valve lifter assembly process includes associating leakdown test results for individual lash adjusters with residual lash test results to minimize total length variation in the deactivation roller hydraulic valves. Another example approach is shown by Hicks in U.S. Pat. No. 6,513,471. Therein, a timing of exhaust cams driving valves of deactivatable cylinders is advanced relative to a timing of exhaust cams driving valves of non-deactivatable cylinders. This results in an amount of overlap of opening time of valves of the deactivatable cylinders to be approximately a same amount of overlap as valves of the non-deactivatable cylinders.

However, the inventors herein have recognized potential issues with such systems. As one example, reducing the length variation between valve-deactivation roller hydraulic valve lifters may reduce an amount of variation in lift and/or lift timing of poppet valves driven by the lifters, but it does not address the issue of differences in lift and/or lift timing of deactivatable poppet valves relative to non-deactivatable poppet valves. As another example, advancing a timing of cams associated with deactivatable valves relative to cams associated with non-deactivatable valves may increase a control complexity of the engine and reduce engine efficiency.

In one example, the issues described above may be addressed by a system, comprising: a camshaft including first and second pluralities of cams, each cam of the first plurality of cams having a first cam lobe profile, and each cam of the second plurality of cams having a different, second cam lobe profile; a plurality of deactivatable cylinder valves driven by the first plurality of cams; and a plurality of non-deactivatable cylinder valves driven by the second plurality of cams. In this way, each of the deactivatable cylinder valves and non-deactivatable cylinder valves may have a same valve opening rate and valve closing rate, and a same amount of valve overlap.

As one example, each cam of the first and second pluralities includes an outer surface tapering from a base section of the cam to a nose of the cam. The outer surface of each cam of the first plurality of cams has a different curvature than the corresponding outer surface of each cam of the second plurality of cams. By configuring the cams in this way, the second plurality of cams drives the non-deactivatable cylinder valves with a same timing and lift amount as the deactivatable cylinder valves driven by the first plurality of cams, and by driving the valves with the same timing and lift amount, combustion stability of an engine including the cams and cylinders may be increased.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 3-4 are shown to scale, though other relative dimensions may be used, if desired.

DETAILED DESCRIPTION

Figure 2:
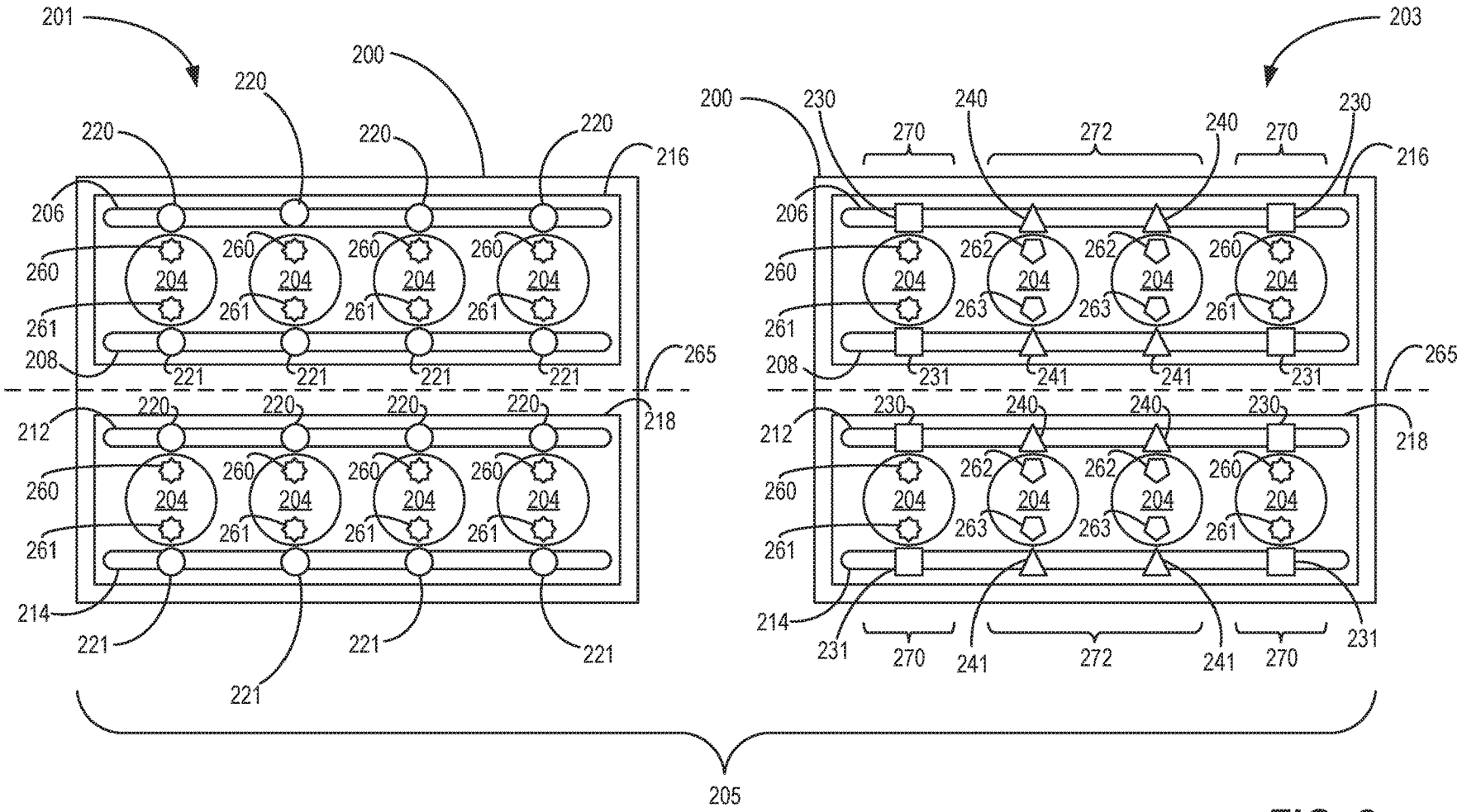
FIG. 2 shows a line of engines including a first engine having non-deactivatable cylinder valves driven by cams with a first cam lobe profile, and a second engine having deactivatable cylinder valves driven by cams with a second cam lobe profile and non-deactivatable cylinder valves driven by cams with a third cam lobe profile.
Figure 3:
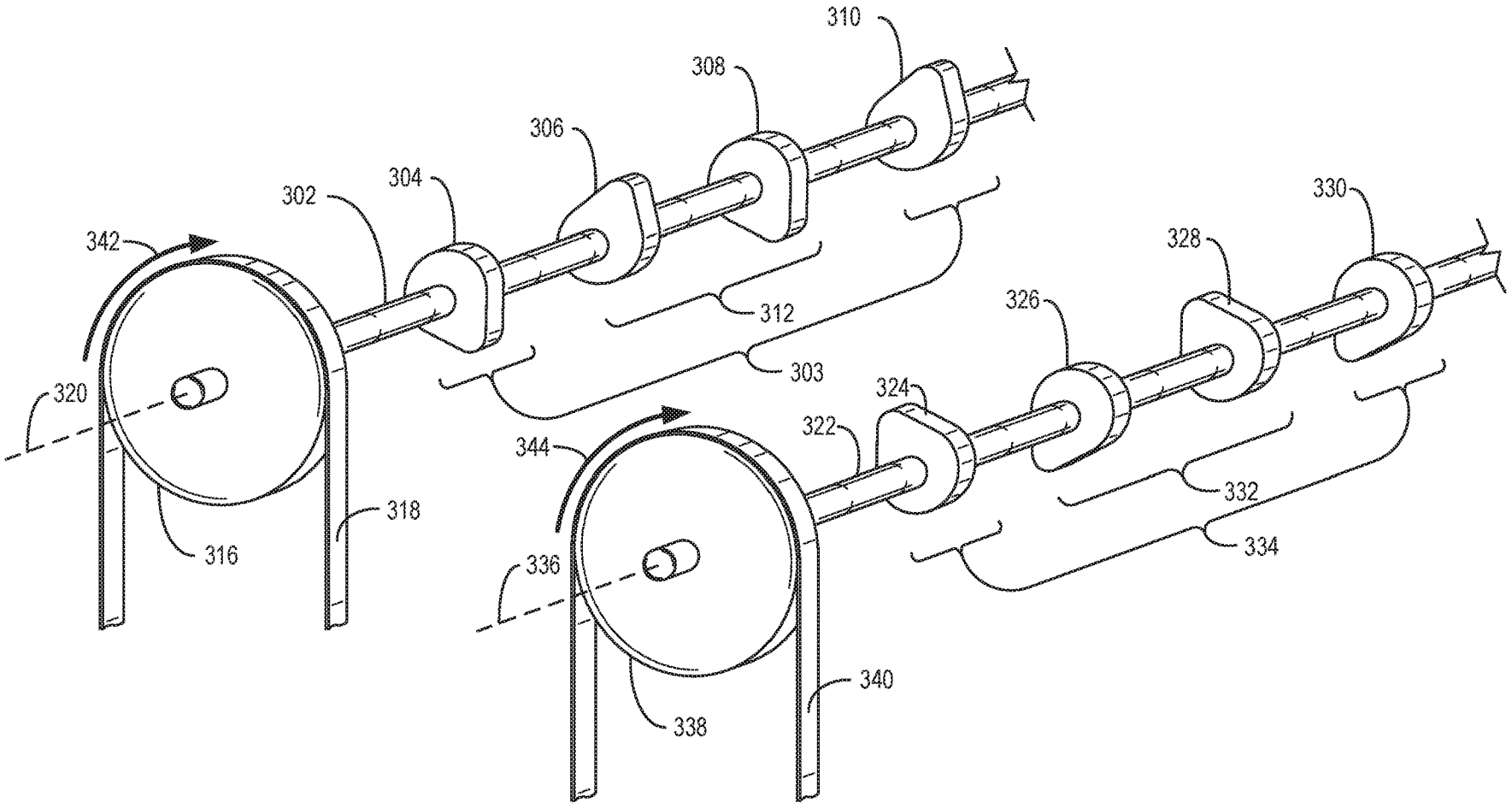
FIG. 3 shows an intake camshaft and an exhaust camshaft of a variable displacement engine, with each camshaft including cams of a first group having a first cam lobe profile and cams of a second group having a second cam lobe profile.
Figure 4:
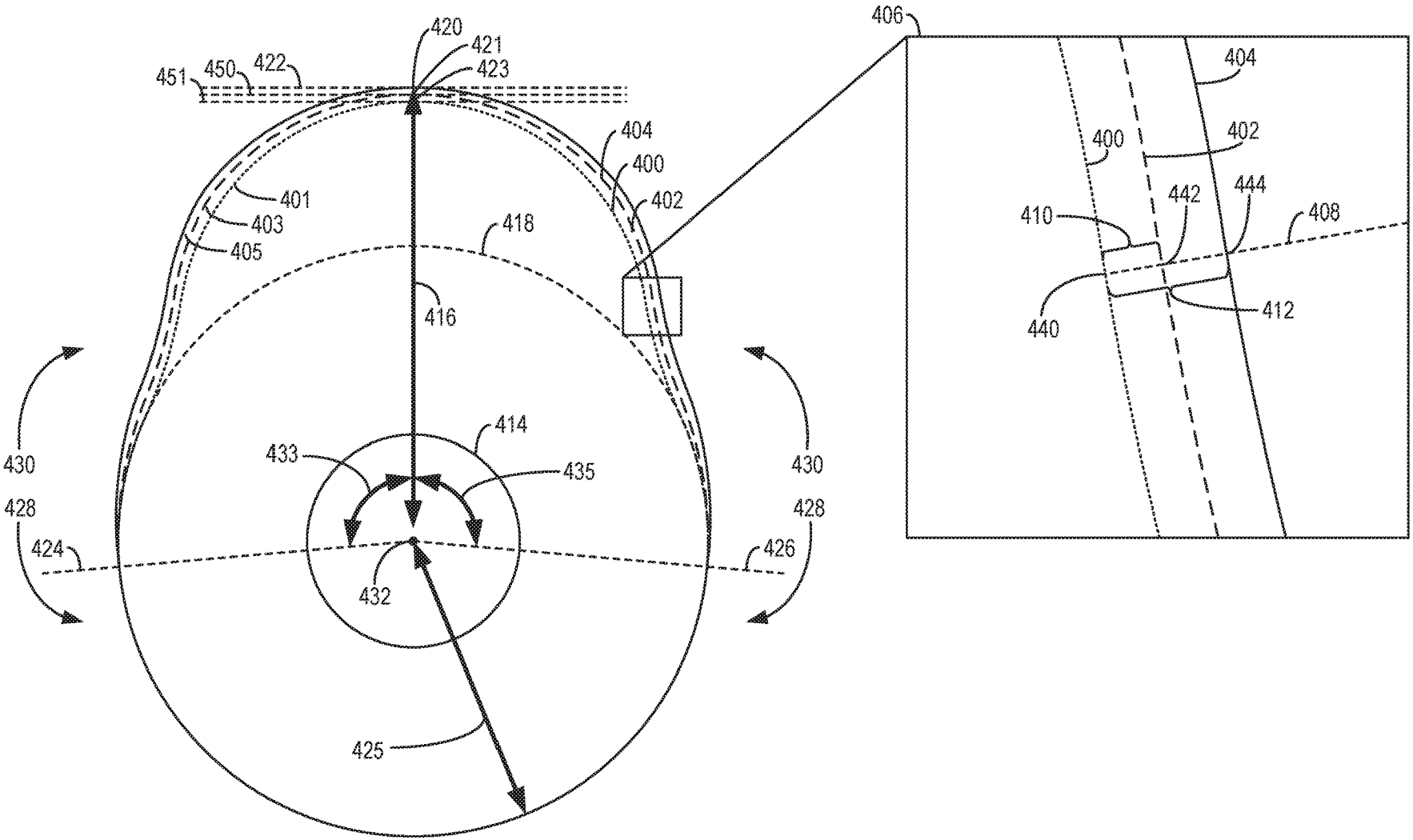
FIG. 4 illustrates the first and second cam lobe profiles of the cams shown by FIG. 3 relative to a cam lobe profile of a cam of an engine that does not include deactivatable cylinder valves.
Figure 5:
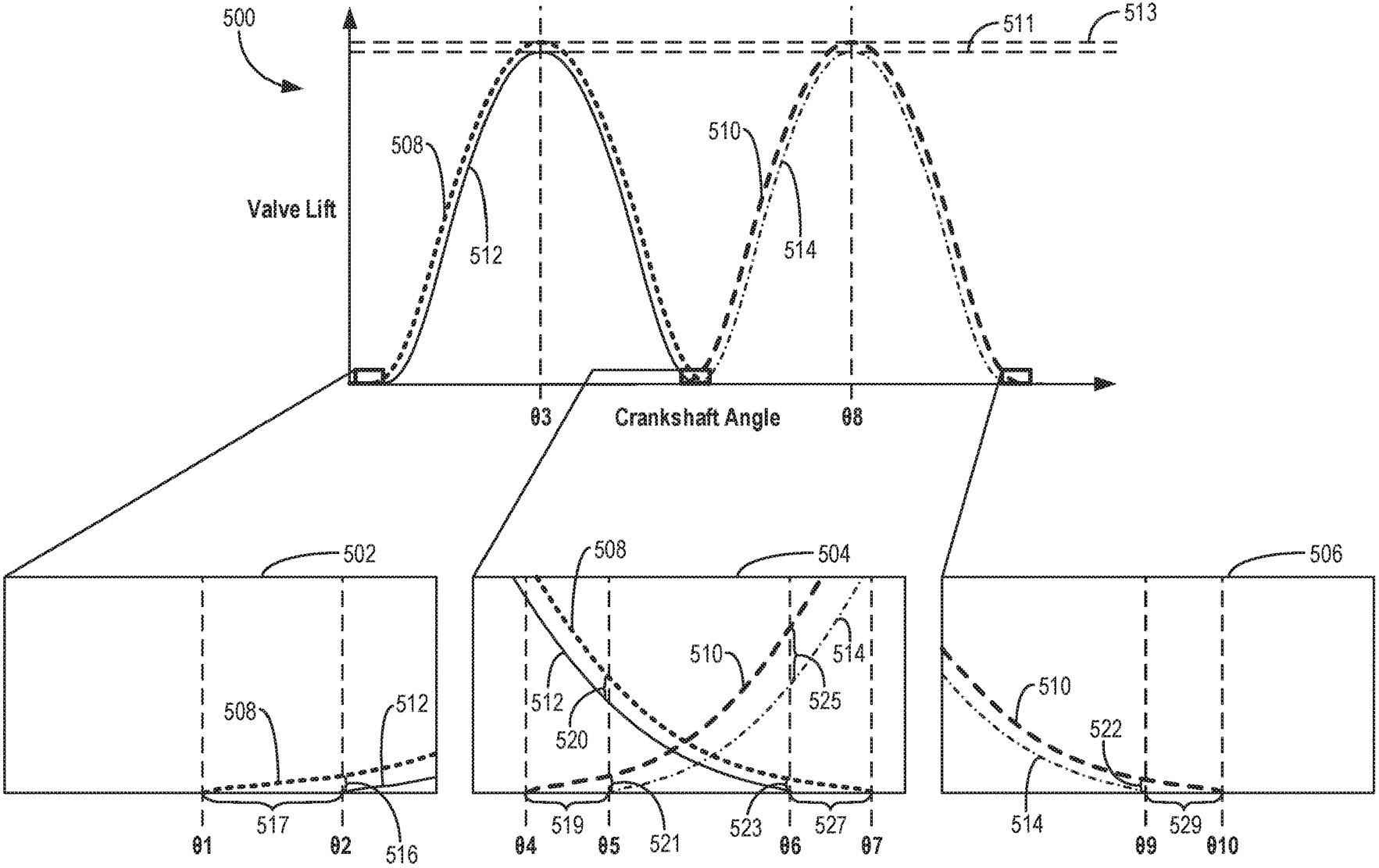
FIG. 5 shows a graph illustrating valve lift profiles of an intake valve and an exhaust valve of a first engine including only non-deactivatable intake and exhaust valves, relative to valve lift profiles of a deactivatable intake valve and a deactivatable exhaust valve of a second engine including both deactivatable and non-deactivatable intake and exhaust valves.
Figure 6:
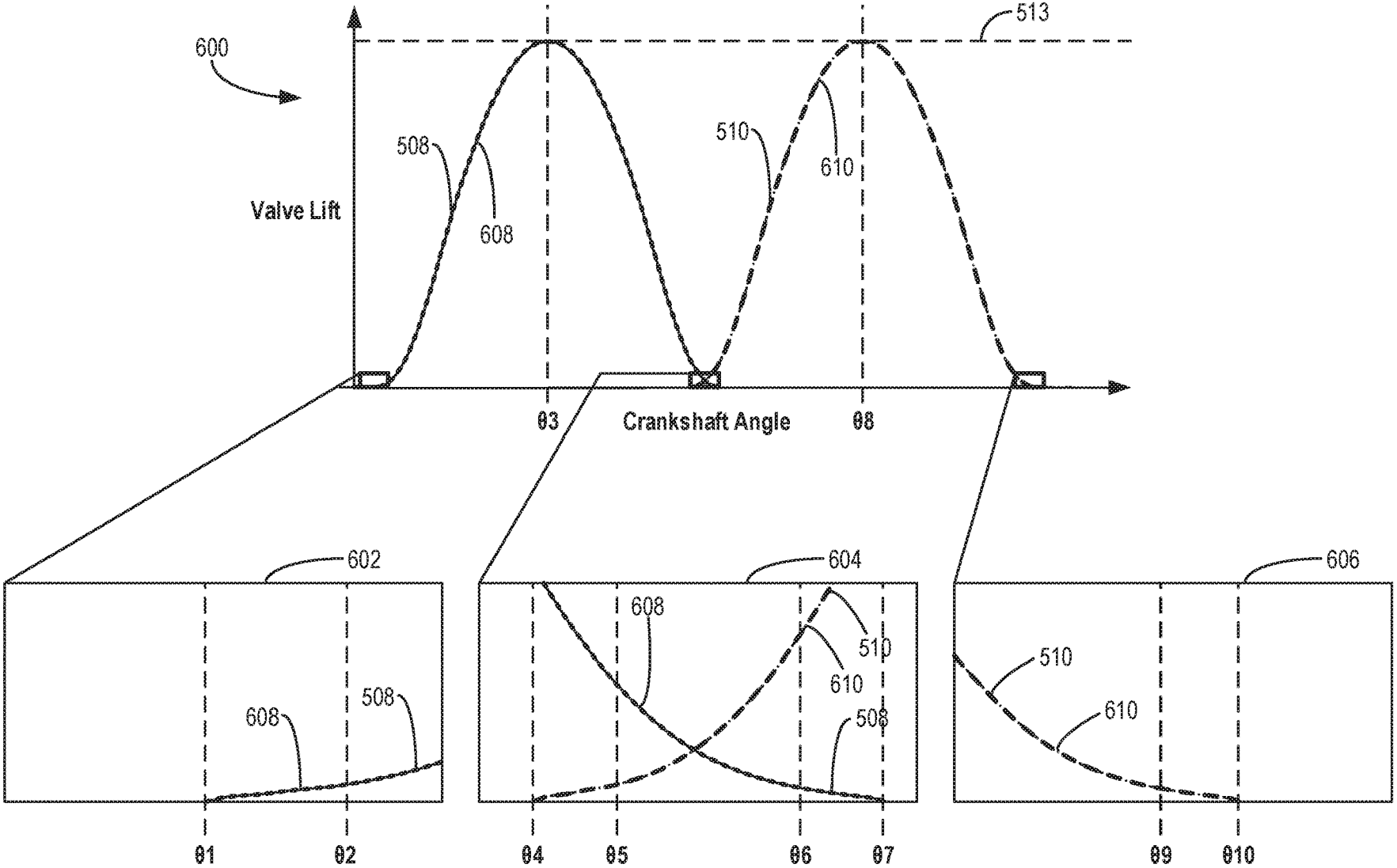
FIG. 6 shows a graph illustrating valve lift profiles of the deactivatable intake valve and deactivatable exhaust valve of the second engine of FIG. 5, relative to valve lift profiles of a non-deactivatable intake valve and a non-deactivatable exhaust valve of the second engine.

The following description relates to systems and methods for an engine including cams having different cam profiles. An engine, such as the engine shown by FIG. 1, includes a plurality of cylinders each having at least one intake valve and at least one exhaust valve. The engine may be a second engine of an engine line, with a first engine of the engine line including only non-deactivatable cylinders, and with the second engine including both non-deactivatable cylinders and deactivatable cylinders, as shown by FIG. 2. The intake valves and exhaust valves are driven by a plurality of cams via rotation of camshafts of the engine, as shown by FIG. 3. Each camshaft of the second engine includes a first group of cams having a first cam lobe profile and a second group of cams having a second cam lobe profile. Valves driven by the first group of cams are switchable from an activated mode to a deactivated mode (and vice versa), and valves driven by the second group of cams are not switchable between the activated and deactivated modes. The first cam lobe profile may have different curvature of outer surfaces relative to the second cam lobe profile, as shown by FIG. 4. The difference in the curvature of the cams of the first group relative to a curvature of the cams of the second group results in a decreased amount of difference in valve lift profiles of the deactivatable valves of the second engine relative to valve lift profiles of the non-deactivatable valves of the second engine, as shown by FIG. 6. The difference in valve lift profiles between the deactivatable valves and non-deactivatable valves of the second engine is greatly reduced relative to a difference between valve lift profiles of the deactivatable valves of the second engine and valve lift profiles of non-deactivatable valves of the first engine that includes only non-deactivatable cylinders, as shown by FIG. 5. By reducing the difference in valve lift profiles between the deactivatable valves and non-deactivatable valves of the second engine via the first group of cams and the second group of cams, a combustion stability and fuel efficiency of the engine may be increased, and a noise, vibration, and harshness (NVH) of the engine may be reduced, particularly at idling speeds.

Figure 1:
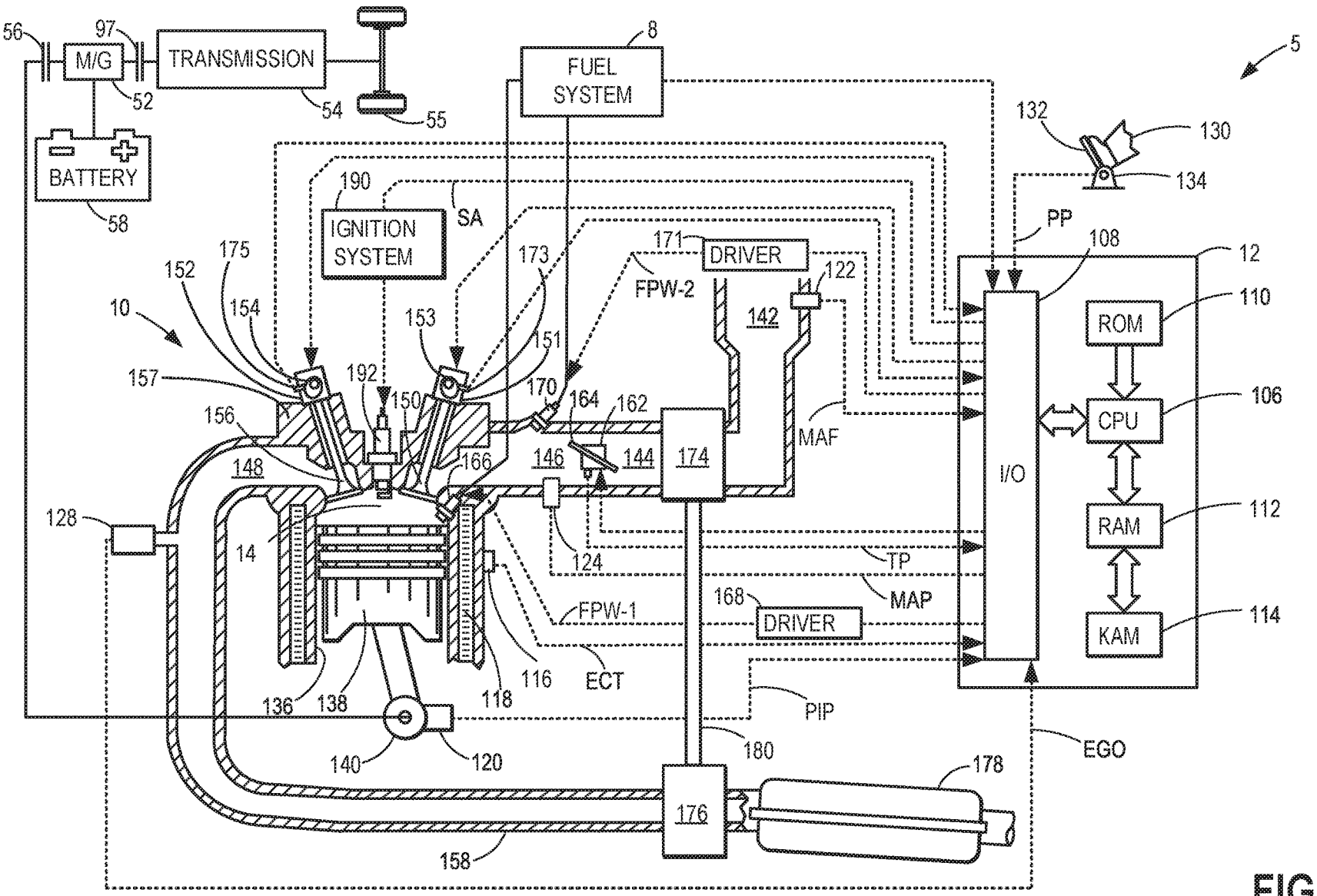
FIG. 1 schematically shows a variable displacement engine including a combustion chamber having intake valves and/or exhaust valves driven via camshaft.

FIG. 1 depicts an example of a combustion chamber or cylinder of internal combustion engine 10. Engine 10 may be controlled at least partially by a control system including controller 12 and by input from a vehicle operator 130 via an input device 132. In this example, input device 132 includes an accelerator pedal and a pedal position sensor 134 for generating a proportional pedal position signal PP. Cylinder (herein also "combustion chamber") 14 of engine 10 may include combustion chamber walls 136 with piston 138 positioned therein. The cylinder 14 is capped by cylinder head 157. Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor (not shown) may be coupled to crankshaft 140 via a flywheel to enable a starting operation of engine 10.

Cylinder 14 can receive intake air via a series of intake air passages 142, 144, and 146. Intake air passage 146 can communicate with other cylinders of engine 10 in addition to cylinder 14. In some examples, one or more of the intake passages may include a boosting device such as a turbocharger or a supercharger. For example, FIG. 1 shows engine 10 configured with a turbocharger including a compressor 174 arranged between intake passages 142 and 144, and an exhaust turbine 176 arranged along exhaust passage 148. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine. A throttle 162 including a throttle plate 164 may be provided along an intake passage of the engine for varying the flow rate and/or pressure of intake air provided to the engine cylinders. For example, throttle 162 may be positioned downstream of compressor 174 as shown in FIG. 1, or alternatively may be provided upstream of compressor 174.

Exhaust passage 148 can receive exhaust gases from other cylinders of engine 10 in addition to cylinder 14. Exhaust gas sensor 128 is shown coupled to exhaust passage 148 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder.

In the example of FIG. 1, intake valve 150 and exhaust valve 156 are actuated (e.g., opened and closed) via respective cam actuation systems 153 and 154. Cam actuation systems 153 and 154 each include one or more cams mounted on one or more camshafts (similar to the example shown by FIG. 2 and described below) and may utilize one or more of cam profile switching (CPS), variable cam timing (VCT), variable valve timing (VVT) and/or variable valve lift (VVL) systems that may be operated by controller 12 to vary valve operation. The angular position of intake and exhaust camshafts may be determined by position sensors 173 and 175, respectively. In alternate embodiments, one or more additional intake valves and/or exhaust valves of cylinder 14 may be controlled via electric valve actuation. For example, cylinder 14 may include one or more additional intake valves controlled via electric valve actuation and one or more additional exhaust valves controlled via electric valve actuation.

Cylinder 14 can have a compression ratio, which is the ratio of volumes when piston 138 is at bottom center to top center. In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, each cylinder of engine 10 may include a spark plug 192 housed within cylinder head 157 for initiating combustion. Ignition system 190 can provide an ignition spark to combustion chamber 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

In some examples, each cylinder of engine 10 may be configured with one or more fuel injectors for providing fuel thereto. As a non-limiting example, cylinder 14 is shown including two fuel injectors 166 and 170. Fuel injectors 166 and 170 may be configured to deliver fuel received from fuel system 8. As elaborated with reference to FIGS. 2 and 3, fuel system 8 may include one or more fuel tanks, fuel pumps, and fuel rails. Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter referred to as "DI") of fuel into combustion cylinder 14. While FIG. 1 shows injector 166 positioned to one side of cylinder 14, it may alternatively be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from a fuel tank of fuel system 8 via a high pressure fuel pump, and a fuel rail. Further, the fuel tank may have a pressure transducer providing a signal to controller 12.

Fuel injector 170 is shown arranged in intake passage 146, rather than in cylinder 14, in a configuration that provides what is known as port injection of fuel (hereafter referred to as "PFI") into the intake port upstream of cylinder 14. Fuel injector 170 may inject fuel, received from fuel system 8, in proportion to the pulse width of signal FPW-2 received from controller 12 via electronic driver 171. Note that a single driver 168 or 171 may be used for both fuel injection systems, or multiple drivers, for example driver 168 for fuel injector 166 and driver 171 for fuel injector 170, may be used, as depicted.

In an alternate example, each of fuel injectors 166 and 170 may be configured as direct fuel injectors for injecting fuel directly into cylinder 14. In still another example, each of fuel injectors 166 and 170 may be configured as port fuel injectors for injecting fuel upstream of intake valve 150. In yet other examples, cylinder 14 may include only a single fuel injector that is configured to receive different fuels from the fuel systems in varying relative amounts as a fuel mixture, and is further configured to inject this fuel mixture either directly into the cylinder as a direct fuel injector or upstream of the intake valves as a port fuel injector. As such, it should be appreciated that the fuel systems described herein should not be limited by the particular fuel injector configurations described herein by way of example.

Fuel may be delivered by both injectors to the cylinder during a single cycle of the cylinder. For example, each injector may deliver a portion of a total fuel injection that is combusted in cylinder 14. Further, the distribution and/or relative amount of fuel delivered from each injector may vary with operating conditions, such as engine load, knock, and exhaust temperature, such as described herein below. The port injected fuel may be delivered during an open intake valve event, closed intake valve event (e.g., substantially before the intake stroke), as well as during both open and closed intake valve operation. Similarly, directly injected fuel may be delivered during an intake stroke, as well as partly during a previous exhaust stroke, during the intake stroke, and partly during the compression stroke, for example. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

Fuel injectors 166 and 170 may have different characteristics, such as differences in size. For example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among injectors 170 and 166, different effects may be achieved.

Fuel tanks in fuel system 8 may hold fuels of different fuel types, such as fuels with different fuel qualities and different fuel compositions. The differences may include different alcohol content, different water content, different octane, different heats of vaporization, different fuel blends, and/or combinations thereof etc. One example of fuels with different heats of vaporization could include gasoline as a first fuel type with a lower heat of vaporization and ethanol as a second fuel type with a greater heat of vaporization. In another example, the engine may use gasoline as a first fuel type and an alcohol containing fuel blend such as E85 (which is approximately 85% ethanol and 15% gasoline) or M85 (which is approximately 85% methanol and 15% gasoline) as a second fuel type. Other feasible substances include water, methanol, a mixture of alcohol and water, a mixture of water and methanol, a mixture of alcohols, etc.

In still another example, both fuels may be alcohol blends with varying alcohol composition wherein the first fuel type may be a gasoline alcohol blend with a lower concentration of alcohol, such as E10 (which is approximately 10% ethanol), while the second fuel type may be a gasoline alcohol blend with a greater concentration of alcohol, such as E85 (which is approximately 85% ethanol). Additionally, the first and second fuels may also differ in other fuel qualities such as a difference in temperature, viscosity, octane number, etc. Moreover, fuel characteristics of one or both fuel tanks may vary frequently, for example, due to day to day variations in tank refilling.

In some examples, vehicle 5 may be a hybrid vehicle with multiple sources of torque available to one or more vehicle wheels 55. In other examples, vehicle 5 is a conventional vehicle with only an engine, or an electric vehicle with only electric machine(s). In the example shown, vehicle 5 includes engine 10 and an electric machine 52. Electric machine 52 may be a motor or a motor/generator. Crankshaft 140 of engine 10 and electric machine 52 are connected via a transmission 54 to vehicle wheels 55 when one or more clutches are engaged. In the depicted example, a first clutch 56 is provided between crankshaft 140 and electric machine 52, and a second clutch 97 is provided between electric machine 52 and transmission 54. Controller 12 may send a signal to an actuator of each clutch (e.g., first clutch 56 and/or second clutch 97) to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from a traction battery 58 to provide torque to vehicle wheels 55. Electric machine 52 may also be operated as a generator to provide electrical power to charge battery 58, for example during a braking operation.

As described above, FIG. 1 shows only one cylinder of multi-cylinder engine 10. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

Engine 10 is a variable displacement engine, and cylinder 14 may be one of a plurality of deactivatable or non-deceivable cylinders of the engine 10. For example, one or more valves of the cylinder 14 (e.g., intake valve 150 and/or exhaust valve 156) may be adjustable by the controller 12 from an activated mode to a deactivated mode (and vice versa). For example, cylinder 14 may be a deactivatable cylinder, with the intake valve 150 and exhaust valve 156 each being coupled to respective deactivatable valve assemblies. In some examples the deactivatable valve assemblies may adjust an operational mode of their corresponding coupled valves in response to signals transmitted to the deactivatable valve assemblies by the controller 12. Intake valve 150 is shown coupled to deactivatable valve assembly 151 and exhaust valve 156 is shown coupled to deactivatable valve assembly 152.

In one example, the controller 12 may transmit electrical signals to the deactivatable valve assembly 151 in order to adjust the operational mode of the intake valve 150 from an activated mode to a deactivated mode (or vice versa) and/or the controller 12 may transmit electrical signals to the deactivatable valve assembly 152 in order to adjust the operational mode of the exhaust valve 156 from an activated mode to a deactivated mode (or vice versa). In another example, each of the deactivatable valve assemblies (e.g., deactivatable valve assembly 151 and deactivatable valve assembly 152) may include a rocker arm coupled to a hydraulic lash adjuster. For example, deactivatable valve assembly 151 may include a hydraulic lash adjuster configured to reduce a lash (e.g., an amount of gap) between the rocker arm and an intake cam of cam actuation system 153. Adjusting a pressure of oil flowing into the hydraulic lash adjuster and/or rocker arm may adjust the hydraulic lash adjuster and/or rocker arm (respectively) from an activated mode to a deactivated mode (and vice versa).

In one example, in the activated mode, the rocker arm of deactivatable valve assembly 151 coupled to the intake valve 150 is pressed into engagement with the intake cam of cam actuation system 153 (e.g., pressed into engagement by the hydraulic lash adjuster) so that a rotational motion of the intake cam of cam actuation system 153 (e.g., rotational motion resulting from a rotation of a camshaft coupled to the intake cam of cam actuation system 153 by the engine 10) is converted into a pivoting motion of the rocker arm, and the pivoting motion of the rocker arm is converted into a linear motion of the intake valve 150. The linear motion of the intake valve 150 enables intake air to flow through the intake air passage 146 and into the cylinder 14. For example, as the intake valve 150 is moved toward the cylinder 14 (e.g., towards an opened position), a flow of intake air around the intake valve 150 from the intake air passage 146 and into the cylinder 14 may be increased. As the intake valve 150 is moved away from the cylinder 14 (e.g., towards a closed position), the flow of intake air around the intake valve 150 from the intake air passage 146 and into the cylinder 14 may be decreased. In this way, movement of the intake valve 150 provides the cylinder 14 with intake air for combustion within the cylinder 14. Similarly, in the activated mode, movement of the exhaust valve 156 (e.g., via deactivatable valve assembly 152) enables combusted fuel/air mixture to be exhausted from the cylinder 14 into exhaust passage 148.

However, in the deactivated mode, the rocker arm coupled to the intake valve 150 is not pressed into engagement with the intake cam of cam actuation system 153 (e.g., not pressed into engagement by the hydraulic lash adjuster). As a result, the rotational motion of the intake cam of cam actuation system 153 is not converted into the pivoting motion of the rocker arm, and the intake valve 150 does not move from the closed position toward the opened position. During conditions in which the intake valve 150 is in the deactivated mode, intake air does not flow into the cylinder 14 (e.g., via the intake passage 146). Similarly, during conditions in which the exhaust valve 156 is in the deactivated mode, combustion gases are not exhausted from the cylinder 14 (e.g., via the exhaust passage 148). By deactivating both of the intake valve 150 and the exhaust valve 156, combustion of fuel/air within the cylinder 14 may be prevented for a duration (e.g., one or more complete cycles of the engine 10). Additionally, during conditions in which both of the intake valve 150 and the exhaust valve 156 are in the deactivated mode, the controller 12 may reduce an amount of fuel provided to the cylinder 14 (e.g., via electrical signals transmitted to fuel injector 170 and/or fuel injector 166) and/or may reduce an amount of spark produced by spark plug 192 disposed within the cylinder 14.

Although operation of the cylinder 14 is adjusted via the deactivatable valve assemblies 151 and 152 as described above, in some examples (such as the example shown by FIG. 2 and described below) operation of one or more cylinders of the engine 10 may not be adjusted by deactivatable valve assemblies. For example, the engine 10 may include four cylinders (e.g., cylinder 14), with operation of a first pair of the cylinders being adjustable via deactivatable valve assemblies and operation of a second pair of cylinders not being adjustable via deactivatable valve assemblies.

In the example described above, transmitting electrical signals to the deactivatable valve assemblies via the controller may include transmitting electrical signals to one or more hydraulic fluid valves fluidly coupled to the respective hydraulic lash adjusters and/or rocker arms in order to adjust the hydraulic fluid valves to a fully closed position, a fully opened position, or a plurality of positions between the fully closed position and the fully opened position. In some examples, moving the one or more hydraulic fluid valves to an opened position may increase a pressure of oil at the hydraulic lash adjusters and/or rocker arms to operate the cylinder valves (e.g., intake valve 150 and exhaust valve 156) in the deactivated mode, and moving the hydraulic fluid valves to the closed position may not increase the pressure of oil at the hydraulic lash adjusters and/or rocker arms to operate the cylinder valves in the activated mode.

Although operation of the intake valve 150 is described above as an example, the exhaust valve 156 may operate in a similar way (e.g., with the operational mode of the exhaust valve 156 being adjusted via the deactivatable valve assembly 152).

The controller 12 receives signals from the various sensors of FIG. 1 and employs the various actuators of FIG. 1 to adjust engine operation based on the received signals and instructions stored on a memory of the controller. For example, adjusting the intake valve 150 from the activated mode to the deactivated mode may include adjusting an actuator of the intake valve 150 (e.g., deactivatable valve assembly 151) to adjust an amount of movement of the intake valve 150 relative to cylinder 14. For example (as described above), the controller 12 may transmit electrical signals to a hydraulic fluid valve of the deactivatable valve assembly 151 (with the deactivatable valve assembly 151 coupled to the intake valve 150) in order to move the hydraulic fluid valve of the deactivatable valve assembly 151 from the closed position to an opened position. Moving the hydraulic fluid valve of the deactivatable valve assembly 151 to the opened position may increase a pressure of hydraulic fluid (e.g., oil) at the hydraulic lash adjuster and/or rocker arm of the deactivatable valve assembly 151. The increased pressure results in the rocker arm being disengaged from the intake valve 150, thereby adjusting the intake valve to the deactivated mode. Similarly, the controller 12 may transmit electrical signals to the hydraulic fluid valve of the deactivatable valve assembly 151 in order to move the hydraulic fluid valve to an opened position and thereby adjust the intake valve 150 to the activated mode.

Adjusting the rocker arms between the activated mode and deactivated mode may adjust one or more corresponding cylinders of the engine from an activated mode to a deactivated mode (and vice versa).

Controller 12 is shown in FIG. 1 as a microcomputer, including microprocessor unit 106, input/output ports 108, an electronic storage medium for executable programs and calibration values shown as non-transitory read only memory chip 110 in this particular example for storing executable instructions, random access memory 112, keep alive memory 114, and a data bus. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; and absolute manifold pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold. Controller 12 may infer an engine temperature based on an engine coolant temperature.

FIG. 2 schematically shows an engine line (e.g., a line of engines) 205 including a first engine 201 and a second engine 203. First engine 201 and second engine 203 each include a plurality of identical components. Each identical component included by the first engine 201 and second engine 203 may be labeled similarly.

The first engine 201 and the second engine 203 each include a same engine block 200. Engine block 200 forms a plurality of cylinders 204, and the cylinders 204 are capped by a cylinder head (such as the cylinder head 157 shown by FIG. 1 and described above). In the example shown by FIG. 2, the engine block 200 includes eight cylinders 204 positioned in a V-arrangement (e.g., with a first cylinder bank 216 positioned opposite to a second cylinder bank 218 across a centerline 265 of the engine block 200, the first cylinder bank 216 and second cylinder bank 218 each including four cylinders 204). In other examples, the engine block 200 may include only a single cylinder bank and/or a different number of cylinders (e.g., three, four, six, twelve, etc.).

The first engine 201 and the second engine 203 each include a plurality of camshafts adapted to drive intake valves and exhaust valves of the cylinders 204. Specifically, cylinders 204 of the first cylinder bank 216 include intake valves driven by first intake camshaft 206 and exhaust valves driven by first exhaust camshaft 208, and cylinders 204 of the second cylinder bank 218 include intake valves driven by second intake camshaft 212 and exhaust valves driven by second exhaust camshaft 214. First intake camshaft 206, first exhaust camshaft 208, second intake camshaft 212, and second exhaust camshaft 214 of the first engine 201 are identical to the first intake camshaft 206, first exhaust camshaft 208, second intake camshaft 212, and second exhaust camshaft 214, respectively, of the second engine 203.

Although the first engine 201 and the second engine 203 each include the same camshafts, cylinders, cylinder banks, and engine block as described above, the first engine 201 and the second engine 203 each have a different cam configuration, intake valve assembly configuration, and exhaust valve assembly configuration relative to each other. For example, each cylinder 204 of the first engine 201 may receive airflow via a corresponding intake valve assembly 260 of a plurality of identical intake valve assemblies, and combusted air/fuel (e.g., exhaust gases) may flow out of each cylinder 204 of the first engine 201 via a corresponding exhaust valve assembly of a plurality of identical exhaust valve assemblies 261.

Each intake valve assembly 260 of the first engine 201 is coupled to a corresponding cam of a plurality of identical intake cams 220, and each exhaust valve assembly 261 of the first engine 201 is coupled to a corresponding cam of a plurality of identical exhaust cams 221. Each intake cam 220 of the first engine 201 is identical to each other intake cam 220 of the first engine 201, and each exhaust cam 221 of the first engine 201 is identical to each other exhaust cam 221. For example, each of the intake cams 220 of the first engine 201 has a same shape and size (e.g., a same cam lobe profile, which may be referred to herein as a first intake cam lobe profile or conventional intake cam lobe profile) as each of the other intake cams 220 of the first engine 201. Similarly, each of the exhaust cams 221 of the first engine 201 has a same shape and size (e.g., a same cam lobe profile, which may be referred to herein as a first exhaust cam lobe profile or conventional exhaust cam lobe profile) as each of the other exhaust cams 221 of the first engine 201.

Each intake valve assembly 260 of the first engine 201 is identical to each other intake valve assembly 260 of the first engine 201, and each exhaust valve assembly 261 of the first engine 201 is identical to each other exhaust valve assembly 261 of the first engine 201. The intake valve assemblies 260 each include a non-deactivatable intake valve that may be driven by a non-deactivatable rocker arm coupled to a non-deactivatable hydraulic lash adjuster. The exhaust valve assemblies 261 each include a non-deactivatable exhaust valve that may be driven by a rocker arm coupled to a non-deactivatable hydraulic lash adjuster. As referred to herein, a non-deactivatable intake valve refers to an intake valve that is not adjustable from an activated mode (e.g., a mode in which the intake valve opens and closes to flow intake air into a cylinder in response to rotation of a cam engaged with the intake valve via a non-deactivatable rocker arm and non-deactivatable hydraulic lash adjuster) to a deactivated mode (e.g., a mode in which the intake valve does not open and remains in the closed position during a complete rotation of the cam, such that intake air does not flow into the cylinder via the intake valve). Similarly, a non-deactivatable exhaust valve refers to an exhaust valve that is not adjustable from an activated mode (e.g., a mode in which the exhaust valve opens and closes to flow exhaust gases out of a cylinder in response to rotation of a cam engaged with the exhaust valve via a non-deactivatable rocker arm and non-deactivatable hydraulic lash adjuster) to a deactivated mode (e.g., a mode in which the exhaust valve does not open and remains in the closed position during a complete rotation of the cam, such that exhaust gases do not flow out the cylinder via the exhaust valve). A non-deactivatable hydraulic lash adjuster refers to a lash adjuster that is not adjustable from an activated mode (e.g., a mode in which the lash adjuster converts a rotational motion of a cam into a pivoting motion of a rocker arm) to a deactivated mode (e.g., a mode in which the rotational motion of the cam is not converted into pivoting motion of the rocker arm). Similarly, a non-deactivatable rocker arm refers to a rocker arm that is not adjustable from an activated mode (e.g., a mode in which the rotational motion of the cam is converted into a pivoting motion of the rocker arm) to a deactivated mode (e.g., a mode in which the rotational motion of the cam is not converted into pivoting motion of the rocker arm).

A cylinder configured to receive intake air only via a non-deactivatable intake valve and to exhaust combustion gases (e.g., combusted fuel/air) only via a non-deactivatable exhaust valve may be referred to herein as a non-deactivatable cylinder. As one example, each cylinder 204 of first engine 201 is a non-deactivatable cylinder (e.g., the intake valve assemblies 260 coupled to the cylinders 204 each include a non-deactivatable intake valve, and the exhaust valve assemblies 261 coupled to the cylinders 204 each include a non-deactivatable exhaust valve).

Second engine 203, however, includes a first plurality of cylinders that are non-deactivatable and a second plurality of cylinders that are deactivatable. Specifically, each cylinder 204 of the second engine 203 that is non-deactivatable is coupled to a corresponding intake valve assembly 260 that includes a non-deactivatable intake valve and a corresponding exhaust valve assembly 261 that includes a non-deactivatable exhaust valve. For example, as shown by FIG. 2, the outer cylinders 270 of the second engine 203 (e.g., the cylinders 204 positioned at opposing ends of the first cylinder bank 216 and second cylinder bank 218 in a direction of the centerline 265) are non-deactivatable cylinders.

Each of the intake valve assemblies 260 of the non-deactivatable cylinders of the second engine 203 are driven by rotation of one of intake cams 230, and each of the exhaust valve assemblies 261 of the non-deactivatable cylinders of the second engine 203 are driven by rotation of one of exhaust cams 231. For example, the non-deactivatable cylinders of the first cylinder bank 216 of second engine 203 (e.g., the outer cylinders 270) include intake valve assemblies 260 driven by rotation of intake cams 230 coupled to intake camshaft 206, and include exhaust valve assemblies 261 driven by rotation of exhaust cams 231 coupled to exhaust camshaft 208. The non-deactivatable cylinders of the second cylinder bank 218 of second engine 203 similarly include intake valve assemblies 260 driven by rotation of intake cams 230 coupled to intake camshaft 212, and include exhaust valve assemblies 261 driven by rotation of exhaust cams 231 coupled to exhaust camshaft 214. Each of the intake cams 230 driving the intake valve assemblies of the non-deactivatable cylinders is identical in shape and size, and each of the exhaust cams 231 driving the exhaust valve assemblies of the non-deactivatable cylinders is identical in shape and size. For example, each intake cam 230 includes a same intake cam lobe profile (which may be referred to herein as a second intake cam lobe profile), and each exhaust cam 231 includes a same exhaust cam lobe profile (which may be referred to herein as a second exhaust cam lobe profile).

The second plurality of cylinders (e.g., the deactivatable cylinders) includes the innermost cylinders 272 positioned between the outer cylinders 270 of the first cylinder bank 216 and second cylinder bank 218 in a direction of the centerline 265. Although the deactivatable cylinders are the innermost cylinders 272 in the example shown by FIG. 2, in other examples the second engine 203 may include a different arrangement of deactivatable cylinders relative to non-deactivatable cylinders (e.g., with the deactivatable cylinders and non-deactivatable cylinders positioned in an alternating arrangement, with the outer cylinders 270 being deactivatable and the innermost cylinders 272 being non-deactivatable, etc.). In one example, the outer cylinders 270 of the first cylinder bank 216 may be deactivatable and the innermost cylinders 272 may be non-deactivatable, and the outer cylinders 270 of the second cylinder bank 218 may be non-deactivatable and the innermost cylinders 272 of the second cylinder bank 218 may be deactivatable. Other example relative arrangements of deactivatable cylinders and non-deactivatable cylinders are possible. Each of the deactivatable cylinders is coupled to a corresponding intake valve assembly 262 including a deactivatable intake valve and a corresponding exhaust valve assembly 263 including a deactivatable exhaust valve.

As referred to herein, a deactivatable intake valve refers to an intake valve that is adjustable from the activated mode (e.g., the mode in which the intake valve opens and closes to flow intake air into a cylinder in response to rotation of a cam engaged with the intake valve via a rocker arm and hydraulic lash adjuster) to the deactivated mode (e.g., the mode in which the intake valve does not open and remains in the closed position during a complete rotation of the cam, such that intake air does not flow into the cylinder via the intake valve). Similarly, a deactivatable exhaust valve refers to an exhaust valve that is adjustable from the activated mode (e.g., the mode in which the exhaust valve opens and closes to flow exhaust gases out of a cylinder in response to rotation of a cam engaged with the exhaust valve via a rocker arm and hydraulic lash adjuster) to the deactivated mode (e.g., the mode in which the exhaust valve does not open and remains in the closed position during a complete rotation of the cam, such that exhaust gases do not flow out the cylinder via the exhaust valve). A deactivatable hydraulic lash adjuster refers to a lash adjuster that is adjustable from the activated mode (e.g., the mode in which the lash adjuster converts a rotational motion of a cam into a pivoting motion of a rocker arm) to the deactivated mode (e.g., the mode in which the rotational motion of the cam is not converted into pivoting motion of the rocker arm). A deactivatable rocker arm refers to a rocker arm that is adjustable from an activated mode (e.g., a mode in which the rotational motion of the cam is converted into a pivoting motion of the rocker arm) to a deactivated mode (e.g., a mode in which the rotational motion of the cam is not converted into pivoting motion of the rocker arm).

In some examples, the deactivatable intake valves and deactivatable exhaust valves may be adjustable from the activated modes to the deactivated modes (and vice versa) in response to electrical signals transmitted to the intake valve assemblies 262 and exhaust valve assemblies 263 by a controller of the engine as described above with reference to controller 12 of engine 10 shown by FIG. 1. For example, the controller may transmit an electrical signal to one or more hydraulic fluid valves of the intake valve assemblies 262 in order to adjust an oil pressure at the corresponding deactivatable hydraulic lash adjusters and/or deactivatable rocker arms of the intake valve assemblies 262, and adjusting the oil pressure may adjust the intake valve assemblies 262 from the activated mode to the deactivated mode (or vice versa). Although the intake valve assemblies 262 are described by the example above, exhaust valve assemblies 263 may be adjusted from the activated mode to the deactivated mode (and vice versa) in a similar way (e.g., in response to adjusting an oil pressure at the corresponding deactivatable hydraulic lash adjusters and/or deactivatable rocker arms of the exhaust valve assemblies 263 via the controller).

Each of the intake valve assemblies 262 of the deactivatable cylinders are driven by rotation of one of intake cams 240, and each of the exhaust valve assemblies 263 of the deactivatable cylinders are driven by rotation of one of exhaust cams 241. For example, the deactivatable cylinders of the first cylinder bank 216 of second engine 203 (e.g., the innermost cylinders 272) include intake valve assemblies 262 driven by rotation of intake cams 240 coupled to intake camshaft 206, and include exhaust valve assemblies 263 driven by rotation of exhaust cams 241 coupled to exhaust camshaft 208. The deactivatable cylinders of the second cylinder bank 218 of second engine 203 similarly include intake valve assemblies 262 driven by rotation of intake cams 240 coupled to intake camshaft 212, and include exhaust valve assemblies 263 driven by rotation of exhaust cams 241 coupled to exhaust camshaft 214. Each of the intake cams 240 driving the intake valve assemblies of the deactivatable cylinders is identical in shape and size, and each of the exhaust cams 241 driving the exhaust valve assemblies of the deactivatable cylinders is identical in shape and size. For example, each intake cam 240 includes a same intake cam lobe profile (which may be referred to herein as a third intake cam lobe profile), and each exhaust cam 241 includes a same exhaust cam lobe profile (which may be referred to herein as a third exhaust cam lobe profile).

As described above, the intake valve assemblies 260 of the first engine 201 are each driven by the intake cams 220, and each of the intake cams 220 has a same size and shape (e.g., each of the intake cams 220 has the first intake cam lobe profile). The exhaust valve assemblies 261 of the first engine 201 are each driven by the exhaust cams 221, and each of the exhaust cams 221 has a same size and shape (e.g., each of the exhaust cams 221 has the first exhaust cam lobe profile). Because each of the cylinders 204 of the first engine 201 includes identical intake valve assemblies 260, identical exhaust valve assemblies 261, intake cams 220 having an identical size and shape, and exhaust valves 221 having an identical size and shape, each of the cylinders 204 of the first engine 201 has a same amount of intake valve and exhaust valve overlap for each single complete combustion cycle (e.g., intake stroke, compression stroke, power stroke, and exhaust stroke of the cylinder) relative to each other cylinder 204 of the first engine 201. However, as described above, each cylinder 204 of the first engine 201 is a non-deactivatable cylinder. As a result, none of the cylinders 204 of the first engine 201 are adjustable to the deactivated mode. The controller of the first engine 201 may not, for example, transmit electrical signals to the valve assemblies (e.g., intake valve assemblies 260 and/or exhaust valve assemblies 261) of the first engine 201 in order to deactivate one or more of the cylinders 204 of the first engine 201 (e.g., to prevent combustion of air/fuel within the one or more cylinders, for example, by closing the intake valves of the intake valve assemblies 260 and/or the exhaust valves of the exhaust valve assemblies 261).

However, the second engine 203 includes deactivatable cylinders (e.g., innermost cylinders 272) and non-deactivatable cylinders (e.g., outer cylinders 270), and the intake valve assemblies 260 and exhaust valve assemblies 261 of the non-deactivatable cylinders are different than the intake valve assemblies 262 and exhaust valve assemblies 263 of the deactivatable cylinders. As described above, the intake valve assemblies 262 each include a deactivatable intake valve and the exhaust valve assemblies 263 each include a deactivatable exhaust valve. In one example, the deactivatable intake valve of each of the intake valve assemblies 262 is adjustable from the activated mode to the deactivated mode (and vice versa) by adjusting an oil pressure at a corresponding deactivatable hydraulic lash adjuster and/or deactivatable rocker arm coupled to the deactivatable intake valve, and the deactivatable exhaust valve of each of the exhaust valve assemblies 263 is adjustable from the activated mode to the deactivated mode (and vice versa) by adjusting an oil pressure at a corresponding deactivatable hydraulic lash adjuster and/or deactivatable rocker arm coupled to the deactivatable exhaust valve, as described above.

The intake valve assemblies 262 and exhaust valve assemblies 263 may include different components (e.g., deactivatable rocker arms and deactivatable hydraulic lash adjusters having different internal oil passages, pins, springs, bearings, etc.) relative to the non-deactivatable intake valve assemblies 260 and exhaust valve assemblies 261 that enable the intake valve assemblies 262 and exhaust valve assemblies 263 to be adjusted from the activated mode to the deactivated mode. However, the different components of the intake valve assemblies 262 and exhaust valve assemblies 263 may result in the deactivatable intake valve assemblies 262 and deactivatable exhaust valve assemblies 263 having different operating characteristics relative to the non-deactivatable intake valve assemblies 260 and non-deactivatable exhaust valve assemblies 261.

In one example, the intake valve assemblies 262 and exhaust valve assemblies 263 may each include a deactivatable rocker arm having a lash (e.g., a clearance) positioned within a body of the deactivatable rocker arm, and the lash may result in a different amount of engagement of a roller of the rocker arm with a corresponding cam relative to rollers of rocker arms of non-deactivatable valve assemblies. For example, intake valve assemblies 262 may include deactivatable rocker arms having rollers in engagement with intake cams 240 of intake camshaft 206. A lash within a body of the each deactivatable rocker arm of the intake valve assemblies 262 may result in the roller of each deactivatable rocker arm pressing against the corresponding engaged intake cams 240 with a first amount of force. However, rollers of non-deactivatable rocker arms of intake valve assemblies 260 of the second engine 203 may press against their corresponding engaged intake cams 230 with a second amount of force, with the second amount of force being different than the first amount of force.

The amount of engagement of the rollers of the deactivatable rocker arms with the intake cams 240 differs relative to the amount of engagement of the rollers of the non-deactivatable rocker arms with the intake cams 230, and the amount of engagement of the rollers of the deactivatable rocker arms with the exhaust cams 241 differs relative to the amount of engagement of the rollers of the non-deactivatable rocker arms with the exhaust cams 231. The shape and/or size of the intake cams 240 (e.g., the cams having the third intake cam lobe profile) is different than the shape and/or size of the intake cams 230 (e.g., the cams having the second intake cam lobe profile), and the shape and/or size of the exhaust cams 241 (e.g., the cams having the third exhaust cam lobe profile) is different than the shape and/or size of the exhaust cams 231 (e.g., the cams having the second exhaust cam lobe profile). As a result, an amount of overlap of the intake valves driven by the intake cams 240 with the exhaust valves driven by the exhaust cams 241 (e.g., the valves of the deactivatable cylinders) is the same as an amount of overlap of the intake valves driven by the intake cams 230 of the second engine 203 with the exhaust valves driven by the exhaust cams 231 of the second engine 203 (e.g., the valves of the non-deactivatable cylinders of the second engine 203). Overlap of intake valves and exhaust valves as described above refers to an amount of valve lift of an intake valve and an exhaust valve through a duration in which both the intake valve and exhaust valve are each in an opened position, the duration occurring in a single combustion cycle of a cylinder, with the intake valve and exhaust valve each coupled to the cylinder.

By configuring the intake cams 240 with the third intake cam lobe profile and the exhaust cams 241 with the third exhaust cam lobe profile, a performance and/or durability of the intake valve assemblies 262, exhaust valve assemblies 263, intake cams 240, and/or exhaust cams 241 may be increased. For example, engaging intake cams having the first intake cam lobe profile or the second intake cam lobe profile with the intake valve assemblies 262 of the deactivatable cylinders of the second engine 203 and engaging exhaust cams having the first exhaust cam lobe profile or second exhaust cam lobe profile with the exhaust valve assemblies 263 of the deactivatable cylinders of the second engine 203 may result in increased noise, vibrations, and/or harshness (NVH) during operation of the second engine 203. The increased NVH results from the differing components of the intake valve assemblies 262 and the exhaust valve assemblies 263 (e.g., rocker arms having a body with a lash positioned therein) relative to the components of the intake valve assemblies 260 and exhaust valve assemblies 261 (as described above). However, by engaging intake cams having the third intake cam lobe profile (e.g., intake cams 240) with the intake valve assemblies 262 of the deactivatable cylinders of the second engine 203 (as shown by FIG. 2) and engaging exhaust cams having the third exhaust cam lobe profile (e.g., exhaust cams 241) with the exhaust valve assemblies 263 of the deactivatable cylinders of the second engine 203 (as shown by FIG. 2) may reduce degradation of the intake cams 240, exhaust cams 241, intake valve assemblies 262, and/or exhaust valve assemblies 263.

Because the third intake cam lobe profile (e.g., the shape of intake cams 240) is different than the first intake cam lobe profile (e.g., the shape of intake cams 220 of first engine 201), and because the third exhaust cam lobe profile (e.g., the shape of exhaust cams 241) is different than the first exhaust cam lobe profile (e.g., the shape of exhaust cams 221 of first engine 201), an amount of overlap of the valves of the deactivatable cylinders of the second engine 203 is different than an amount of overlap of the valves of the non-deactivatable cylinders of the first engine 201. In order to configure each cylinder of the second engine 203 to have a same amount of valve overlap relative to each other cylinder of the second engine 203 (e.g., a same amount of overlap as the deactivatable cylinders having intake valves driven by the intake cams 240 and exhaust valves driven by the exhaust cams 241), intake valves of the non-deactivatable cylinders of the second engine 203 (e.g. the outer cylinders 270) are driven by intake cams 230 having the second intake cam lobe profile and exhaust valves of the non-deactivatable cylinders of the second engine 203 are driven by exhaust cams 231 having the second exhaust cam lobe profile. The second intake cam lobe profile is different than the first intake cam lobe profile of intake cams 220 of first engine 201, and the second exhaust cam lobe profile is different than the first exhaust cam lobe profile of exhaust cams 221 of first engine 201. Additionally, because the intake valve assemblies 260 and exhaust valve assemblies 261 of the non-deactivatable cylinders of the second engine 203 include different components having different operating characteristics (as described above) relative to the intake valve assemblies 262 and exhaust valve assemblies 263 of the deactivatable cylinders of the second engine 203, the second intake cam lobe profile is different than the third intake cam lobe profile and the second exhaust cam lobe profile is different than the third exhaust cam lobe profile to enable the valves (e.g., intake valves and exhaust valves) of the non-deactivatable cylinders of the second engine 203 to have a same amount of overlap as the valves of the deactivatable cylinders of the second engine 203.

By configuring the intake cams and exhaust cams of the second engine 203 in this way, the intake valves and exhaust valves of each deactivatable and non-deactivatable cylinder of the second engine 203 have a same amount of overlap, resulting in increased combustion stability (particularly during conditions in which the engine is operating with each cylinder being in the activated mode). For example, during engine idling, each cylinder may be in the activated mode, and because the valve overlap of each cylinder is the same (e.g., due to the intake cams 230 having the second intake cam lobe profile, the exhaust cams 231 having the second exhaust cam lobe profile, the intake cams 240 having the third intake cam lobe profile, and the exhaust cams 241 having the third exhaust cam lobe profile), a difference in an amount of gases (e.g., uncombusted intake air and/or combusted air/fuel) residing within each cylinder after each combustion cycle may be reduced. For example, an amount of gases residing within one of the deactivatable cylinders immediately following a combustion cycle of the deactivatable cylinder may be a same amount as an amount of gases residing within one of the non-deactivatable cylinders immediately following a combustion cycle of the non-deactivatable cylinder. By configuring each cylinder (e.g., deactivatable cylinders and non-deactivatable cylinders) to have a same amount of residual gases as described above (e.g., by configuring each cylinder to have a same amount of valve overlap) a torque balance of each cylinder may be increased.

Examples of the first intake cam lobe profile, second intake cam lobe profile, and third intake cam lobe profile are described below with reference to FIG. 4. The first exhaust cam lobe profile, second exhaust cam lobe profile, and third exhaust cam lobe profile may have a similar relative configuration, as described below. Example valve lift amounts corresponding to each cam lobe profile (e.g., intake cam lobe profile and exhaust cam lobe profile) are described below with reference to FIGS. 5-6.

FIG. 3 shows a first camshaft 302 and a second camshaft 322 of an engine similar to the second engine 203 shown by FIG. 2 and described above. For example, first camshaft 302 is similar to the first intake camshaft 206 of the first cylinder bank 216, and second camshaft 322 is similar to the first exhaust camshaft 208 of the first cylinder bank 216, with the first intake camshaft 206, first exhaust camshaft 208, and first cylinder bank 216 being described above with reference to FIG. 2. The first camshaft 302 includes a first plurality of cams 303 (which may be referred to herein as a first cam group) and a second plurality of cams 312 (which may be referred to herein as a second cam group), and the second camshaft 322 includes a third plurality of cams 334 (which may be referred to herein as a third cam group) and a fourth plurality of cams 332 (which may be referred to herein as a fourth cam group). A shape of each cam shown by FIG. 3 is simplified for illustrative purposes. However, examples of relative shapes and sizes of the cams described herein with reference to FIGS. 2-3 are shown by FIG. 4 and described further below.

The first cam group 303 includes intake cams 304 and 310, and the third cam group 334 includes exhaust cams 324 and 330. The intake cams 304 and 310 may be similar to the intake cams 230 shown by FIG. 2 and may have the second intake cam lobe profile as described above. The exhaust cams 324 and 330 may be similar to the exhaust cams 231 shown by FIG. 2 and may have the second exhaust cam lobe profile as described above. The second cam group 312 includes intake cams 306 and 308, and the fourth cam group 332 includes exhaust cams 326 and 328. The intake cams 306 and 308 may be similar to the intake cams 240 shown by FIG. 2 and may include the third intake cam lobe profile as described above. The exhaust cams 326 and 328 may be similar to the exhaust cams 241 shown by FIG. 2 and may include the third exhaust cam lobe profile as described above. The intake cams 304 and 310 of the first cam group 303 drive non-deactivatable intake valves coupled to non-deactivatable cylinders of the engine (e.g., similar to the non-deactivatable intake valves of intake valve assemblies 260 of second engine 203 as described above), and the intake cams 306 and 308 of the second cam group 312 drive deactivatable intake valves coupled to deactivatable cylinders of the engine (e.g., similar to the deactivatable intake valves of intake valve assemblies 262). The exhaust cams 324 and 330 of the third cam group 334 drive non-deactivatable exhaust valves coupled to non-deactivatable cylinders of the engine (e.g., similar to the non-deactivatable exhaust valves of exhaust valve assemblies 261 of second engine 203 as described above), and the exhaust cams 326 and 328 of the fourth cam group 332 drive deactivatable exhaust valves coupled to deactivatable cylinders of the engine (e.g., similar to the deactivatable exhaust valves of exhaust valve assemblies 263 of second engine 203 as described above).

Each camshaft is driven by a corresponding pulley, and each pulley is driven by a crankshaft of the engine. For example, first camshaft 302 is driven by rotation of first pulley 316 around rotational axis 320 (e.g., in rotational direction 342), and second camshaft 322 is driven by rotation of second pulley 338 around rotational axis 336 (e.g., in rotational direction 344), with the first pulley 316 and second pulley 338 each being driven by the crankshaft of the engine via first belt 318 and second belt 340, respectively. In some examples, the first pulley 316 and second pulley 338 may be coupled together (e.g., via a belt or chain) such that the first pulley 316 and second pulley 338 rotate at a same rate. In other examples, the first pulley 316 and second pulley 338 may rotate at different rates.

As described above with reference to FIG. 2, an amount of valve overlap of cylinder valves (e.g., intake valves and exhaust valves) driven by rotation of the first camshaft 302 and the second camshaft 322 is a same amount for each cylinder of the engine. For example, an amount of valve overlap of a non-deactivatable intake valve driven by intake cam 304 of first camshaft 302 and a non-deactivatable exhaust valve driven by exhaust cam 324 of second camshaft 322 is the same as an amount of valve overlap of a deactivatable intake valve driven by intake cam 306 of first camshaft 302 and a deactivatable exhaust valve driven by exhaust cam 326 of second camshaft 322 (e.g., due to the intake cam 304 having the second intake cam lobe profile and the exhaust cam 324 having the second exhaust cam lobe profile, and the intake cam 306 having the third intake cam lobe profile and the exhaust cam 326 having the third exhaust cam lobe profile, as described above). By configuring the engine to have a same amount of valve overlap for each cylinder, a combustion stability of the engine is increased, particularly during conditions in which each cylinder is in the activated mode. In some examples, the combustion stability of the engine is comparable to that of the first engine 201 described above with reference to FIG. 2, with the engine including the first camshaft 302 and second camshaft 322 further including deactivatable cylinders that may be adjusted to the deactivated mode for increased fuel efficiency. In this way, engine performance may be increased and engine noise, vibration, and harshness may be decreased.

FIG. 4 shows a first cam 401, a second cam 403, and a third cam 405 of an engine positioned in alignment with each other along a common rotational axis 432 to illustrate a relative difference between a cam lobe profile of each cam. In one example, first cam 401 may be similar to the intake cams 220 shown schematically by FIG. 2 and described above, second cam 403 may be similar to the intake cams 230 shown schematically by FIG. 2 and the intake cams 304 and 310 shown by FIG. 3, and third cam 405 may be similar to the intake cams 240 shown schematically by FIG. 2 and the intake cams 306 and 308 shown by FIG. 3 and described above. First cam 401 includes a first intake cam lobe profile 400, second cam 403 includes a second intake cam lobe profile 402, and third cam 405 includes a third intake cam lobe profile 404. In some examples, rotational axis 432 may be a rotational axis of a camshaft (e.g., rotational axis 320 or rotational axis 336 described above with reference to FIG. 3). Example cam lobe profiles similar to the first intake cam lobe profile 400, second intake cam lobe profile 402, and third intake cam lobe profile 404 are described above with reference to FIGS. 2-3. The first intake cam lobe profile 400 (similar to the first intake cam lobe profile of cams 220 shown by FIG. 1 and described above) is shown in shortest dashed lines, the second intake cam lobe profile 402 (similar to the second intake cam lobe profile of cams 230 shown by FIG. 2 and cams 304 and 310 described above with reference to FIG. 3) is shown in longer dashed lines, and the third intake cam lobe profile 404 (similar to the third intake cam lobe profile of cams 240 shown by FIG. 2 and cams 306 and 308 described above) is shown in solid lines. As referred to herein, "cam lobe profile" and "lobe profile" refer to a shape and size of outer surfaces (e.g., an outer contour) of a cam that are adapted for engagement with components of a valve assembly (e.g., a roller of a rocker arm), wherein rotation of the cam may result in the outer surfaces pressing against the components of the valve assembly to open and/or close a valve of the valve assembly.

Each of the first cam 401, second cam 403, and third cam 405 are shown with exaggerated features by FIG. 4 for relative comparison of each cam lobe profile (e.g., first intake cam lobe profile 400, second intake cam lobe profile 402, and third intake cam lobe profile 404, respectively). In other examples, the first cam 401, second cam 403, and third cam 405 may be shaped differently than the example shown by FIG. 4. However, in each embodiment, the first intake cam lobe profile 400, second intake cam lobe profile 402, and third intake cam lobe profile 404 are each different relative to each other (e.g., the first cam 401, second cam 403, and third cam 405 are each shaped differently and have a different outer contour relative to each other).

As described above, each cam (e.g., first cam 401, second cam 403, and third cam 405) is aligned with each other cam along rotational axis 432 for comparison of each intake cam lobe profile. Rotational axis 432 extends through a center of a base circle section 418 of each cam in a direction normal to the base circle section 418 (e.g., orthogonal to a plane in which an entirety of the base circle section 418 is positioned). Each cam includes a nose positioned away from the rotational axis 432 in a radial direction of the rotational axis 432 relative to each other cam. For example, first cam 401 includes nose 423, second cam 403 includes nose 421, and third cam 405 includes nose 420. Each nose is positioned a different distance from the rotational axis 432 as each other nose. For example, the nose 420 of the third cam 405 is positioned away from the rotational axis 432 by a first length 416, and the nose 421 of the second cam 403 is positioned away from the rotational axis 432 by a second length less than the first length 416, and the nose 423 of the first cam 401 is positioned away from the rotational axis 432 by a third length less than the second length. The first length 416 is a length from the rotational axis 432 to axis 422, the second length is a length from the rotational axis 432 to axis 450, and the third length is a length from the rotational axis to axis 451, with the axis 422 being arranged tangential to the nose 420 and positioned along the nose 420, the axis 450 being arranged tangential to the nose 421 and positioned along the nose 421, and the axis 451 being arranged tangential to the nose 423 and positioned along the nose 423.

As described above, the nose 423 of the first cam 401, the nose 421 of the second cam 403, and the nose 420 of the third cam 405 are each positioned away from the rotational axis 432 by a different length. For example, the nose 420 of the third cam 405 is positioned away from the rotational axis 432 by the first length 416, and the nose 421 of the second cam 403 and the nose 423 of the first cam 401 are each positioned away from the rotational axis 432 by lengths less than the first length 416. As described above with reference to FIG. 2, deactivatable intake valve assemblies and deactivatable exhaust valve assemblies (e.g., intake valve assemblies 262 and exhaust valve assemblies 263 described above) may each include a deactivatable rocker arm having a lash (e.g., a clearance) positioned within a body of the deactivatable rocker arm. In the example described herein, the lash of the deactivatable rocker arm of a deactivatable intake valve assembly may result in a different amount of engagement of a roller of the deactivatable rocker arm with a corresponding cam (e.g., third cam 405) relative to an amount of engagement of a roller of a non-deactivatable rocker arm of a non-deactivatable valve assembly with a corresponding cam (e.g., first cam 401). Due to the lash of the deactivatable rocker arm and the increased length (e.g., first length 416) of the nose 420 of the third cam 405 from the rotational axis 432 (e.g., relative to the length of the nose 421 of the second cam 403 from the rotational axis 432, and the length of the nose 423 of the first cam 401 from the rotational axis 432), a lift height in the fully opened position of a valve (e.g., intake valve or exhaust valve) driven by the deactivatable rocker arm engaged with the third cam 405 may be different than a lift height in the fully opened position of a valve driven by the non-deactivatable rocker arm engaged with the first cam 401.

As described above, the nose 450 of the second cam 403 is positioned away from the rotational axis 432 by the second length, with the second length being less than the first length 416. In this configuration, although the nose 421 of the second cam 403 and the nose 420 of the third cam 405 are each positioned away from the rotational axis by different amounts (e.g., lengths), a valve driven by the second cam 403 may have a same amount of valve lift in the fully opened position as a valve driven by the third cam 405 due to the lash of the deactivatable rocker arm engaged with the third cam 405. Said another way, the nose 421 of the second cam 403 and the nose 420 of the third cam 405 may each be positioned away from the rotational axis 432 by different amounts to compensate for the lash of the of the deactivatable rocker arm engaged with the third cam 405 and to provide a same lift height of valves driven by the second cam 403 and third cam 405.

The nose of each cam is a portion of each cam (e.g., a portion of each lobe of each cam) that is positioned furthest from the rotational axis 432. During conditions in which the nose is engaged with a roller of a rocker arm of a valve assembly (e.g., intake valve assembly 260 shown by FIG. 2 and described above), the nose 420 presses against the rocker arm to provide a greatest amount of valve lift relative to conditions in which other portions of the cam are engaged with the roller. Said another way, during conditions in which the nose is engaged with the roller of the rocker arm, the corresponding coupled valve of the rocker arm may be moved to the fully opened position (e.g., the position in which gases such as intake air flow into a cylinder via the valve).

Each cam additionally includes a base section 428. The base section 428 is the outer section of each cam positioned nearest to the rotational axis 432. The base section 428 is positioned along a perimeter of the base circle section 418 and corresponds to a portion of each cam that provides a least amount of valve lift during conditions in which the base section 428 is engaged with a roller of a rocker arm. Said another way, during conditions in which the base section 428 is engaged with the roller of the rocker arm, the corresponding coupled valve of the rocker arm may be moved to (or retained in) the fully closed position.

Each cam includes the base section 428 joined with a ramp section 430 at a first axis 424 and a second axis 426, with the first axis 424 and second axis 426 extending radially away from the rotational axis 432. The ramp section 430 and nose 420 together form a lobe (e.g., cam lobe) of each cam (e.g. first cam 401, second cam 403, and third cam 405). In the example shown by FIG. 4, the first axis 424 is angled relative to the length 416 by a first angle 433 and the second axis 426 is angled relative to the length 416 by a second angle 435, with the first angle 433 and second angle 435 being a same amount of angle in opposite directions around the rotational axis 432. In other examples, the first angle 433 and second angle 435 may be a different amount of angle relative to each other, and/or the first angle 433 and second angle 435 may be a different amount of angle relative to the amount shown by FIG. 4.

The ramp section 430 of each cam is a portion that is positioned further from the rotational axis 432 than a length 425 (e.g., a radius of the base section 428) between the base section 428 and the rotational axis 432, and closer to the rotational axis 432 than the length between the nose of the cam and the rotational axis 432 (e.g., length 416 between the nose 420 of third cam 405 and the rotational axis 432). During conditions in which the ramp section 430 is engaged with a roller of a rocker arm of a valve assembly (e.g., intake valve assembly 260 shown by FIG. 2 and described above), the ramp section 430 presses against the rocker arm to provide an amount of valve lift greater than the base section 428 and less than the nose. Said another way, during conditions in which the ramp section 430 is engaged with the roller of the rocker arm, the corresponding coupled valve of the rocker arm is drivable (e.g., may be moved) to a plurality of positions between the fully closed position and the fully opened position (as described above).

As shown by the enlarged view of inset 406, outer surfaces 440 of the first cam 401 form the ramp section of the first cam 401, outer surfaces 442 of the second cam 403 form the ramp section of the second cam 403, and outer surfaces 444 of the third cam 405 form the ramp section of the third camp 405. The outer surfaces 440 of the first cam 401 taper to the nose 423 and the base section 428 of the first cam 401 with a first curvature, the outer surfaces 442 of the second cam 403 taper to the nose 421 and the base section 428 of the second cam 403 with a second curvature, and the outer surfaces 444 of the third cam 405 taper to the nose 420 and the base section 428 of the third cam 405 with a third curvature, with the first curvature, second curvature, and third curvature each being different relative to each other. For example the outer surfaces 440 of the first cam 401 are positioned a shorter distance from the rotational axis 432 than a distance between the outer surfaces 442 of the second cam 403 and the rotational axis 432. Additionally, the outer surfaces 440 of the first cam 401 are positioned a shorter distance from the rotational axis 432 than a distance between the outer surfaces 444 of the third cam 405 and the rotational axis 432. Said another way, a thickness of the second cam 403 along an entire perimeter of the ramp section of the second cam 403 (e.g., at the outer surfaces 442 of the second cam 403) is greater than a thickness of the first cam 401 along an entire perimeter of the ramp section of the first cam 401 (e.g., at the outer surfaces 440 of the first cam 401), and a thickness of the third cam 405 along an entire perimeter of the ramp section of the third cam 405 (e.g., at the outer surfaces 444 of the third cam 405) is greater than the thickness of the second cam 403 along the entire perimeter of the ramp section of the second cam 403.

For example, as indicated by example axis 408 arranged normal to the outer surfaces 440 of the first cam 401 at a location along the perimeter of the ramp section of the first cam 401, the corresponding outer surfaces 442 of the second cam 403 that are aligned with the axis 408 are positioned a distance 410 from the outer surfaces 440 of the first cam 401, and the corresponding outer surfaces 444 of the third cam 405 that are aligned with the axis 408 are positioned a distance 412 from the outer surfaces 440 of the first cam 401, with the distance 412 being greater than the distance 410. In some examples, a curvature (e.g., angle of curvature) of the outer surfaces 442 of the second cam 403 and a curvature of the outer surfaces 444 of the third cam 405 may be similar to a curvature of the outer surfaces 440 of the first cam 401. In the view shown by FIG. 4, the outer surfaces 442 of the second cam 403 are offset relative to outer surfaces 440 of the first cam 401 by a first amount, and the outer surfaces 444 of the third cam 405 are offset from the outer surfaces 440 of the first cam 401 by a second amount, with the first amount and second amount each varying along the curvature of the outer surfaces 440 of the first cam 401, and with second amount being greater than the first amount at each location along the outer surfaces 440 of the first cam 401 (e.g., such that, for each location along the outer surfaces 440 of the first cam 401, an axis positioned normal to the location aligns with both of a corresponding location at the outer surfaces 442 of the second cam 403 and a corresponding location at the outer surfaces 444 of the third cam 405, with the corresponding location at the outer surfaces 444 being further from the location at the outer surfaces 440 along the axis than the corresponding location at the outer surfaces 442).

By configuring the cams to have different shapes (e.g., cam lobe profiles) as described above, the first cam 401, second cam 403, and third cam 405 each engage with valve assemblies (e.g., intake valve assemblies and/or exhaust valve assemblies) of engine cylinders in different ways. For example, because the length 416 from the rotational axis 432 to the nose 420 of the third cam 405 is greater than the length from the rotational axis 432 to the nose 421 of the second cam 403, and because the third cam 405 is configured to drive a deactivatable valve assembly and the second cam 403 is configured to drive a non-deactivatable valve assembly of the same engine, valves driven by the second cam 403 and the third cam 405 have a same lift amount (e.g., an amount of opening of the valve in the fully opened position relative to the fully closed position, wherein the fully opened position corresponds to a greatest amount of pivoting of a rocker arm coupled to the valve due to engagement of the nose with the rocker arm). The lift amount may also be referred to herein as a lift height.

Similarly, because the third cam 405 is adapted to drive deactivatable valves of an engine (such as valves of intake valve assemblies 262 of second engine 203 shown by FIG. 2 and described above) and the second cam 403 is adapted to drive non-deactivatable valves of the same engine (e.g., valves of intake valve assemblies 260 of second engine 203), a curvature of the third cam 405 (e.g., outer surfaces 444 of the third cam 405) is different from a curvature of the second cam 403 (e.g., outer surfaces 442 of the second cam 403) so that a valve lift rate, valve closing rate, and valve overlap amount of each deactivatable and non-deactivatable valve of the engine is the same for each cylinder. For example, as described above with reference to FIG. 2, a deactivatable valve assembly coupled with the third cam 405 may include different components (e.g., deactivatable rocker arms and deactivatable hydraulic lash adjusters having different internal oil passages, pins, springs, bearings, etc.) relative to a non-deactivatable valve assembly coupled with the second cam 403. As a result, the deactivatable valve assembly may have different inherent operating characteristics than the non-deactivatable valve assembly (e.g., a different amount of rocker arm pivoting resistance, different lubrication amounts, etc.). The different curvature of the second cam 403 and third cam 405 enables the valve of the deactivatable valve assembly to be driven by the third cam 405 with a same valve opening rate and valve closing rate as the valve of the non-deactivatable valve assembly driven by the second cam 403. Said another way, the second cam 403 drives the valve of the non-deactivatable valve assembly and the third cam 405 drives the valve of the deactivatable valve assembly in such a way that the difference in the inherent operating characteristics of the valve assemblies is compensated by the shapes of the second cam 403 and third cam 405 so that the valves have the same opening rate and closing rate.

Additionally, configuring the second cam 403 and third cam 405 in this way enables each non-deactivatable cylinder including valves driven by cams identical to the second cam 403 and each deactivatable cylinder including valves driven by cams identical to the third cam 405 to have a same amount of intake valve and exhaust valve overlap, as described in the examples below with reference to FIGS. 5-6. Configuring the valves of the non-deactivatable cylinders to have the same valve lift timing, valve overlap, and valve lift amount as the deactivatable cylinders via the second cam 403 and third cam 405 may increase combustion stability of the engine by reducing torque imbalances between each cylinder and reducing a variation (e.g., a difference) in amounts of air and exhaust (e.g., combusted fuel/air) residing within each cylinder of the engine after each combustion cycle. For example, each cylinder may have a same amount of air and/or exhaust residuals per combustion cycle relative to each other cylinder of the engine.

Although the first cam 401, second cam 403, and third cam 405 described above are intake cams, exhaust cams may include a similar relative configuration (e.g., difference in shape of each exhaust cam relative to each other exhaust cam, similar to the difference in shape between the first cam 401, second cam 403, and third cam 405). In one example, an engine including only non-deactivatable cylinders may include intake cams having only the first intake cam profile and exhaust cams having only a first exhaust cam lobe profile (which may be referred to herein as a fourth cam lobe profile). In another example, an engine including both deactivatable cylinders and non-deactivatable cylinders (as described above) may include deactivatable intake valve assemblies driven by cams similar to the third cam 405 as described above coupled to the deactivatable cylinders of the engine. The deactivatable cylinders may additionally be coupled to deactivatable exhaust valve assemblies driven by exhaust cams having a first exhaust cam lobe profile (which may be referred to herein as a fifth cam lobe profile). Non-deactivatable cylinders of the same engine coupled to the non-deactivatable intake valve assemblies driven by cams similar to the second cam 403 as described above may additionally be coupled to non-deactivatable exhaust valve assemblies driven by exhaust cams having a third exhaust cam lobe profile (which may be referred to herein as a sixth cam lobe profile). The fourth, fifth, and sixth cam lobe profiles are all different from one another. The exhaust cams having the fifth cam lobe profile are shaped differently (e.g., with a different ramp section, length from the rotational axis to the nose, etc.) relative to the exhaust cams having the sixth cam lobe profile, and the difference in shape may cause exhaust valves driven by each exhaust cam to have a same valve lift timing and valve lift amount (e.g., similar to the example described above with regard to the intake valves, second cam 403, and third cam 405).

FIG. 5 shows a graph 500 illustrating deactivatable intake valve and deactivatable exhaust valve lift amounts during a single combustion cycle of a deactivatable cylinder of an engine similar to the second engine 203 described above with reference to FIG. 2. The graph 500 additionally illustrates non-deactivatable intake valve and non-deactivatable exhaust valve lift amounts during a single combustion cycle of a non-deactivatable cylinder of an engine similar to the first engine 201 as described above with reference to FIG. 2. In the example shown by FIG. 5, the deactivatable intake valve may be included within a valve assembly similar to the valve assemblies 262 shown by FIG. 2 and described above, and the exhaust valve may be included within a valve assembly similar to the valve assemblies 263 shown by FIG. 2 and described above, with the valve assemblies 262 being driven by intake cams 240 having the third intake cam lobe profile (e.g., third intake cam lobe profile 404 shown by FIG. 4), and with the valve assemblies 263 being driven by exhaust cams 241 having the third exhaust cam lobe profile. The non-deactivatable intake valve may be included within a valve assembly similar to the valve assemblies 260 of the first engine 201 shown by FIG. 2, and the non-deactivatable exhaust valve may be included within a valve assembly similar to the valve assemblies 261 of the first engine 201, with the valve assemblies 260 being driven by intake cams 220 having the first intake cam lobe profile (e.g., first intake cam lobe profile 400) and the valve assemblies 261 being driven by cams 221 having the first exhaust cam lobe profile.

Plot 508 shows a lift amount (e.g., opening amount) of the exhaust valve of the deactivatable cylinder of the engine similar to the second engine 203, and plot 510 shows a lift amount of the intake valve of the same deactivatable cylinder. Plots 508 and 510 correspond to valve lift amounts during a single combustion cycle of the deactivatable cylinder.

Plot 512 shows a lift amount of the exhaust valve of the non-deactivatable cylinder of the engine similar to the first engine 201, and plot 514 shows a lift amount of the intake valve of the same non-deactivatable cylinder. Plots 512 and 514 correspond to valve lift amounts during a single combustion cycle of the non-deactivatable cylinder, with the single combustion cycle of the non-deactivatable cylinder having a same phase (e.g., relative crankshaft and camshaft angles) as the single combustion cycle of the deactivatable cylinder described above.

As shown by graph 500, each of the non-deactivatable valves described above has a same, first amount of valve lift in the fully opened position as indicated by axis 511, and each of the deactivatable valves has a same, second amount of valve lift in the fully opened position as indicated by axis 513, with the first amount being different than the second amount. In one example, as described above with reference to FIG. 4, a length (e.g., length 416) from a rotational axis to a nose of the cam driving the deactivatable intake valve (e.g., from rotational axis 432 to nose 420) may be different than a length from a rotational axis to a nose of the cam (e.g., nose 423 of first cam 401) driving the non-deactivatable intake valve. Similarly, a nose of the cam driving the non-deactivatable exhaust valve may be positioned a different distance from a rotational axis of the cam relative to distance between a rotational axis and a nose of the cam driving the deactivatable exhaust valve. As a result, the deactivatable intake valve and non-deactivatable intake valve are driven with different amounts of valve lift (e.g., valve opening) in the fully opened position, and the deactivatable exhaust valve and non-deactivatable exhaust valve are driven with different amounts of valve lift in the fully opened position.

Additionally, as shown by first inset 502, an opening rate of the deactivatable exhaust valve of the engine similar to the second engine 203 is different than an opening rate of the non-deactivatable exhaust valve of the engine similar to the second engine 201. For example, at crank angle θ1 shown by first inset 502, the deactivatable exhaust valve of the second engine begins to open (e.g., begins to move away from the fully closed position toward the fully opened position). However, the non-deactivatable exhaust valve of the first engine does not begin to open until crank angle θ2, with the crank angle θ2 being greater than the crank angle θ1 (as indicated by angle 517). At the crank angle θ2, a valve lift of the deactivatable exhaust valve has lifted by an amount 516 greater than a valve lift of the non-deactivatable exhaust valve. As a result, the deactivatable exhaust valve and non-deactivatable exhaust valve each continue to move toward the fully opened position after crank angle θ2 with different valve opening rates.

Second inset 504 shows a valve overlap of the deactivatable exhaust valve with the deactivatable intake valve of the same cylinder of the same engine (e.g., the same cylinder and engine including the deactivatable exhaust valve), with a valve lift of the intake valve indicated by plot 510. Additionally, second inset 504 shows a valve overlap of the non-deactivatable exhaust valve with the non-deactivatable intake valve of the same cylinder of the same engine (e.g., the same cylinder and engine including the non-deactivatable exhaust valve), with a valve lift of the intake valve shown by plot 514.

At crank angle θ4 shown by second inset 504, the deactivatable intake valve of the second engine begins to open (e.g., begins to move away from the fully closed position toward the fully opened position). However, the non-deactivatable intake valve of the first engine does not begin to open until crank angle θ5, with the crank angle θ5 being a greater amount of crank angle than the crank angle θ4 (as indicated by angle 519). At the crank angle θ5, a valve lift of the deactivatable intake valve has lifted by an amount 521 greater than a valve lift of the non-deactivatable intake valve. As a result, the deactivatable intake valve and non-deactivatable intake valve each continue to move toward the fully opened position after crank angle θ5 with different valve opening rates. For example, due to the different valve opening rates, the valve lift of the deactivatable intake valve at crank angle θ6 is greater than a valve lift of the non-deactivatable intake valve by an amount 525, with the amount 525 being greater than the amount 521.

Additionally, at crank angle θ5, the deactivatable exhaust valve and the non-deactivatable exhaust valve are shown by second inset 504 to be moving from a partially opened position (e.g., a position that is partially closed relative to the fully opened position at crank angle θ3, with the crank angle θ3 being the crank angle at which both plot 512 and plot 508 intersect with axis 511) toward the fully closed position at different valve closing rates. At crank angle θ5, the valve lift of the deactivatable exhaust valve is greater than the valve lift of the non-deactivatable exhaust valve by an amount 520. Due to the different valve closing rates, the non-deactivatable exhaust valve moves to the fully closed position at crank angle θ6, and the deactivatable exhaust valve moves to the fully closed position at crank angle θ7, with the crank angle θ7 being greater than the crank angle θ6 (as indicated by angle 527). As a result, the valve lift of the deactivatable exhaust valve is greater than the valve lift of the non-deactivatable exhaust valve at crank angle θ6 by an amount 523.

As shown by third inset 506, the deactivatable intake valve and the non-deactivatable intake valve are moving from a partially opened position (e.g., a position that is partially closed relative to the fully opened position at crank angle θ8, with the crank angle θ8 being the crank angle at which both plot 510 and plot 514 intersect with axis 511) toward the fully closed position at different valve closing rates. At crank angle θ9, the valve lift of the deactivatable intake valve is greater than the valve lift of the non-deactivatable intake valve by an amount 522. Due to the different valve closing rates, the non-deactivatable intake valve moves to the fully closed position at crank angle θ9, and the deactivatable intake valve moves to the fully closed position at crank angle θ10, with the crank angle θ10 being greater than the crank angle θ9 (as indicated by angle 529).

FIG. 6 shows a graph 600 illustrating the intake valve and exhaust valve lift amounts of the deactivatable cylinder as described above with reference to graph 500 shown by FIG. 5, and shows intake valve and exhaust valve lift amounts during a single combustion cycle of a non-deactivatable cylinder of the same engine including the deactivatable cylinder (e.g., the engine similar to the second engine 203 described above with reference to FIG. 2).

Graph 600 shows plots 508 and 510 illustrating the valve lift amounts of the deactivatable exhaust valve and deactivatable intake valve (respectively) as described above with reference to FIG. 5. Graph 600 additionally shows plot 608 illustrating valve lift amounts of a non-deactivatable exhaust valve and plot 610 illustrating valve lift amounts of a non-deactivatable intake valve of the same engine including the deactivatable exhaust valve and deactivatable intake valve described above (e.g., the valves with valve lifts corresponding to plots 508 and 510 as described above).

First inset 602 shows a view similar to the first inset 502 described above with reference to FIG. 5. In particular, the first inset 602 shows an opening rate of the deactivatable exhaust valve (as indicated by plot 508) relative to an opening rate of the non-deactivatable exhaust valve (as indicated by plot 608). In the example of the first inset 502 shown by FIG. 5, the deactivatable exhaust valve and non-deactivatable exhaust valve have different valve opening rates (as indicated by the amount 516 of valve lift between plot 508 and plot 512) due to the non-deactivatable exhaust valve being driven by a cam with the first exhaust cam lobe profile (e.g., similar to exhaust cams 221 of first engine 201 shown by FIG. 2) and the deactivatable exhaust valve being driven by a cam with the third exhaust cam lobe profile (e.g., similar to cams 241 of second engine 203, and cams 326 and 328 shown by FIG. 3). However, in the example shown by first inset 602 of FIG. 6, the deactivatable exhaust valve and non-deactivatable exhaust valve have a same valve opening rate (as indicated by there being no difference between plot 508 and plot 608 similar to the amount 512 shown by FIG. 5) due to the deactivatable exhaust valve being driven by the cam with the third exhaust cam lobe profile and the non-deactivatable exhaust valve being driven by a cam with the second exhaust cam lobe profile different from the first exhaust cam lobe profile (e.g., similar to cams 231 of the second engine 203 shown by FIG. 2, and cams 324 and 330 shown by FIG. 3).

By configuring the deactivatable exhaust valve and the non-deactivatable exhaust valve of the same engine to have a same valve opening rate (e.g., valve lift rate) via the cams including the second and third exhaust cam lobe profiles as described above, combustion stability of the engine may be increased. In one example, configuring the exhaust valves of the deactivatable cylinders and the non-deactivatable cylinders to have the same valve opening rate may reduce a difference in an amount of combustion gases (e.g., combusted air/fuel) remaining within each engine cylinder, relative to each other cylinder, after each complete combustion cycle.

Second inset 604 shows a view similar to the second inset 504 described above with reference to FIG. 5. In particular, the second inset 604 shows a valve overlap of the deactivatable exhaust valve (as indicated by plot 508) with the deactivatable intake valve of the same cylinder (as indicated by plot 510), and additionally shows a valve overlap of the non-deactivatable exhaust valve of the same engine (indicated by plot 608) with a non-deactivatable intake valve of the same cylinder (e.g., the same non-deactivatable cylinder coupled with the non-deactivatable exhaust valve). As described above, in the example of the second inset 504 shown by FIG. 5, the deactivatable exhaust valve and non-deactivatable exhaust valve have different valve closing rates (as indicated by the amount 520 of valve lift between plot 508 and plot 512) due to the non-deactivatable exhaust valve being driven by the cam with the first exhaust cam lobe profile (e.g., similar to cams 221 of first engine 201 shown by FIG. 2) and the deactivatable exhaust valve being driven by the cam with the third exhaust cam lobe profile (e.g., similar to cams 241 of second engine 203, and cams 326 and 328 shown by FIG. 3). However, in the example shown by second inset 604 of FIG. 6, the deactivatable exhaust valve and non-deactivatable exhaust valve have a same valve closing rate (as indicated by there being no difference between plot 508 and plot 608 similar to the amount 520 shown by FIG. 5) due to the deactivatable exhaust valve being driven by the cam with the third exhaust cam lobe profile and the non-deactivatable exhaust valve being driven by the cam with the second exhaust cam lobe profile (e.g., similar to cams 231 of the second engine 203 shown by FIG. 2, and cams 324 and 330 shown by FIG. 3).

Second inset 604 additionally shows an opening rate of the deactivatable intake valve of the engine (as indicated by plot 510) relative to an opening rate of a non-deactivatable intake valve of the same engine (as indicated by plot 610). As described above, in the example of the second inset 504 shown by FIG. 5, the deactivatable intake valve and non-deactivatable intake valve have different valve opening rates (as indicated by the amount 525 of valve lift between plot 510 and plot 514) due to the non-deactivatable intake valve being driven by a cam with the first intake cam lobe profile (e.g., similar to cams 220 of first engine 201 shown by FIG. 2, and first cam 401 shown by FIG. 4) and the deactivatable intake valve being driven by a cam with the third intake cam lobe profile (e.g., similar to cams 240 of second engine 203, cams 306 and 308 shown by FIG. 3, and third cam 405 of FIG. 4). However, in the example shown by second inset 604 of FIG. 6, the deactivatable intake valve and non-deactivatable intake valve have a same valve opening rate (as indicated by there being no difference between plot 510 and plot 610 similar to the amount 525 shown by FIG. 5) due to the deactivatable intake valve being driven by the cam with the third intake cam lobe profile and the non-deactivatable intake valve being driven by a cam with the second intake cam lobe profile (e.g., similar to cams 230 of the second engine 203 shown by FIG. 2, cams 304 and 310 shown by FIG. 3, and second cam 403 shown by FIG. 4).

By configuring the deactivatable exhaust valves and deactivatable intake valves to have a same amount of valve overlap with each other relative to an amount of valve overlap of non-deactivatable exhaust valves with the non-deactivatable intake valves of the same engine, combustion stability may be increased. As described above, each of the cylinders (e.g., deactivatable and non-deactivatable cylinders) has a same amount of valve overlap due to each of the exhaust valves having a same valve closing rate and each of the intake valves having a same valve opening rate. In one example, configuring the cylinders to each have a same amount of valve overlap may increase combustion stability and/or decrease torque imbalances of one or more cylinders. For example, as described above, the difference in the amount of combustion gases (e.g., combusted air/fuel) remaining within each engine cylinder after each complete combustion cycle, relative to each other cylinder, may be reduced.

Third inset 606 shows a view similar to the third inset 506 described above with reference to FIG. 5. In particular, the third inset 606 shows a valve closing rate of the deactivatable intake valve (as indicated by plot 510) relative to a valve closing rate of the non-deactivatable intake valve of the same cylinder (as indicated by plot 610). As described above, in the example of the third inset 506 shown by FIG. 5, the deactivatable intake valve and the non-deactivatable intake valve have different valve closing rates (as indicated by the amount 522 of valve lift between plot 510 and plot 514) due to the non-deactivatable intake valve being driven by the cam with the first intake cam lobe profile (e.g., similar to cams 220 of first engine 201 shown by FIG. 2, and first cam 401 shown by FIG. 4) and the deactivatable intake valve being driven by the cam with the third intake cam lobe profile (e.g., similar to cams 240 of second engine 203, cams 306 and 308 shown by FIG. 3, and third cam 405 of FIG. 4). However, in the example shown by third inset 606 of FIG. 6, the deactivatable intake valve and non-deactivatable intake valve have a same valve closing rate (as indicated by there being no difference between plot 510 and plot 610 similar to the amount 522 shown by FIG. 5) due to the deactivatable intake valve being driven by the cam with the third intake cam lobe profile and the non-deactivatable intake valve being driven by the cam with the second intake cam lobe profile (e.g., similar to cams 230 of the second engine 203 shown by FIG. 2, cams 304 and 310 shown by FIG. 3, and second cam 403 shown by FIG. 4).

By configuring the deactivatable intake valves and non-deactivatable intake valves of the same engine to have a same valve closing rate via the cams with different cam lobe profiles as described above, combustion stability may be increased. In one example, configuring the deactivatable intake valves and non-deactivatable intake valves of the same engine to have a same valve closing rate may increase combustion stability and/or reduce the difference in the amount of combustion gases (e.g., combusted air/fuel) remaining within each engine cylinder, relative to each other cylinder, after each complete combustion cycle. Additionally, in the configuration described above with reference to FIG. 6, the deactivatable intake valves and non-deactivatable intake valves of the same engine may have a same amount of valve lift (as indicated by axis 513), and the deactivatable exhaust valves and non-deactivatable exhaust valves of the same engine may have a same amount of valve lift.

FIGS. 3-4 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

In this way, the engine is configured to have deactivatable intake valves and deactivatable exhaust valves driven by cams including the third cam lobe profile to counteract the different operating characteristics of the deactivatable valve assemblies relative to non-deactivatable valve assemblies. The engine is additionally configured to have non-deactivatable intake valves and non-deactivatable exhaust valves driven by cams including the second cam lobe profile so that intake valves and exhaust valves of each cylinder have a same valve opening rate, valve closing rate, and valve overlap relative to each other cylinder of the same engine. The technical effect of configuring the deactivatable valves to be driven by cams having the third cam lobe profile and configuring the non-deactivatable valves to be driven by cams having the second cam lobe profile is to increase combustion stability and reduce the difference in the amount of combustion gases (e.g., combusted air/fuel) remaining within each engine cylinder after each complete combustion cycle, relative to each other cylinder of the same engine.

In one embodiment, a system comprises: a camshaft including first and second pluralities of cams, each cam of the first plurality of cams having a first cam lobe profile, and each cam of the second plurality of cams having a different, second cam lobe profile; a plurality of deactivatable cylinder valves driven by the first plurality of cams; and a plurality of non-deactivatable cylinder valves driven by the second plurality of cams. In a first example of the system, each valve of the plurality of deactivatable cylinder valves is drivable from a fully closed position to a fully opened position by a corresponding cam of the first plurality of cams, each valve of the plurality of non-deactivatable cylinder valves is drivable from a fully closed position to a fully opened position by a corresponding cam of the second plurality of cams, and a lift amount of each valve of the plurality of deactivatable cylinder valves from the fully closed position to the fully opened position is a same amount as a lift amount of each valve of the plurality of non-deactivatable cylinder valves from the fully closed position to the fully opened position. A second example of the system optionally includes the first example, and further includes wherein the first cam lobe profile includes a first base section, a first nose, and a first ramp section, the second cam lobe profile includes a second base section, a second nose, and a second ramp section, and wherein a radius of the first base section is a same amount of length as a radius of the second base section. A third example of the system optionally includes one or both of the first and second examples, and further includes wherein a length from a center of the first base section to the first nose in a radial direction of the first base section is a different amount than a length from a center of the second base section to the second nose in a radial direction of the second base section. A fourth example of the system optionally includes one or more or each of the first through third examples, and further includes wherein the first ramp section tapers to the first nose and the first base section with a first curvature, wherein the second ramp section tapers to the second nose and the second base section with a second curvature, and wherein the first curvature is different than the second curvature. A fifth example of the system optionally includes one or more or each of the first through fourth examples, and further includes wherein each location along an entire perimeter of the first ramp section is offset in a direction away from a rotational axis of the camshaft by greater amount than each corresponding location of an entire perimeter of the second ramp section. A sixth example of the system optionally includes one or more or each of the first through fifth examples, and further includes wherein each cam of the first plurality of cams includes a first nose positioned a first length from a rotational axis of the camshaft in a radial direction of the rotational axis, and each cam of the second plurality of cams includes a second nose positioned a different, second length from the rotational axis of the camshaft in the radial direction. A seventh example of the system optionally includes one or more or each of the first through sixth examples, and further includes wherein the plurality of deactivatable cylinder valves driven by the first plurality of cams are adapted to have a first valve lift when driven by a cam lobe of each cam of the first plurality of cams, wherein the plurality of non-deactivatable cylinder valves driven by the second plurality of cams are adapted to have a second valve lift when driven by a cam lobe of each cam of the second plurality of cams, and wherein the first valve lift is equal to the second valve lift.

In another embodiment, a system comprises: an intake camshaft and an exhaust camshaft; a first intake cam and a second intake cam coupled to the intake camshaft, the first intake cam having a different cam lobe profile than the second intake cam, the first intake cam adapted to drive an intake valve of a first engine cylinder and the second intake cam adapted to drive an intake valve of a second engine cylinder; and a first exhaust cam and a second exhaust cam coupled to the exhaust camshaft, the first exhaust cam having a different cam lobe profile than the second exhaust cam, the first exhaust cam adapted to drive an exhaust valve of the first engine cylinder and the second exhaust cam adapted to drive an exhaust valve of the second engine cylinder. In a first example of the system, the cam lobe profile of the first intake cam is different than the cam lobe profile of the first exhaust cam, and wherein the cam lobe profile of the second intake cam is different than the cam lobe profile of the second exhaust cam. A second example of the system optionally includes the first example, and further includes wherein a valve overlap of the intake valve and exhaust valve of the first cylinder for a single combustion cycle of the first cylinder is a same amount as a valve overlap of the intake valve and exhaust valve of the second cylinder for a single combustion cycle of the second cylinder. A third example of the system optionally includes one or both of the first and second examples, and further includes wherein a valve opening rate of the intake valve of the first cylinder for a single combustion cycle of the first cylinder is the same as a valve opening rate of the intake valve of the second cylinder for a single combustion cycle of the second cylinder. A fourth example of the system optionally includes one or more or each of the first through third examples, and further includes wherein a valve closing rate of the exhaust valve of the first cylinder for a single combustion cycle of the first cylinder is the same as a valve closing rate of the exhaust valve of the second cylinder for a single combustion cycle of the second cylinder. A fifth example of the system optionally includes one or more or each of the first through fourth examples, and further includes wherein the intake valve and exhaust valve of the first engine cylinder are non-deactivatable valves each driven by corresponding non-deactivatable rocker arms, and wherein the intake valve and exhaust valve of the second engine cylinder are deactivatable valves each driven by corresponding deactivatable rocker arms. A sixth example of the system optionally includes one or more or each of the first through fifth examples, and further includes wherein the first engine cylinder and second engine cylinder are disposed within a first cylinder bank, and further comprising a second, opposing cylinder bank, the second cylinder bank including: a second intake camshaft and a second exhaust camshaft; a third intake cam and a fourth intake cam coupled to the second intake camshaft, the third intake cam having a same cam lobe profile as the first intake cam and the fourth intake cam having a same cam lobe profile as the second intake cam, the third intake cam adapted to drive an intake valve of a third engine cylinder disposed within the second cylinder bank and the fourth intake cam adapted to drive an intake valve of a fourth engine cylinder disposed within the second cylinder bank; and a third exhaust cam and a fourth exhaust cam coupled to the second exhaust camshaft, the third exhaust cam having a same cam lobe profile as the first exhaust cam and the fourth exhaust cam having a same cam lobe profile as the second exhaust cam, the third exhaust cam adapted to drive an exhaust valve of the third engine cylinder and the fourth exhaust cam adapted to drive an exhaust valve of the fourth engine cylinder.

In one embodiment, a line of engines comprises: a first engine including a first plurality of cylinders having only a first set of non-deactivatable intake valves and a first camshaft including a first plurality of cams adapted to drive the first set of non-deactivatable intake valves, where all cams of the first plurality of cams have a same, first cam lobe profile; and a second engine including a second plurality of cylinders having a second set of non-deactivatable intake valves, a third plurality of cylinders having a third set of deactivatable intake valves, and a second camshaft including a second plurality of cams adapted to drive the second set of non-deactivatable intake valves and a third plurality of cams adapted to drive the third set of deactivatable intake valves, where the second plurality of cams have a second cam lobe profile and the third plurality of cams have a third cam lobe profile, where the first, second, and third cam lobe profiles are all different from one another. In a first example of the line, each cam of the first plurality of cams, second plurality of cams, and third plurality of cams has a different length from a nose of each cam to a base section of each cam along an axis normal to the nose. A second example of the line optionally includes the first example, and further includes wherein: the first plurality of cylinders additionally includes only a first set of non-deactivatable exhaust valves and the first engine additionally includes a third camshaft including a fourth plurality of cams adapted to drive the first set of non-deactivatable exhaust valves, where all cams of the fourth plurality of cams have a same, fourth cam lobe profile; and a second set of non-deactivatable exhaust valves is coupled to the second plurality of cylinders, a third set of deactivatable exhaust valves is coupled to the third plurality of cylinders, and the second engine includes a fourth camshaft including a fifth plurality of cams adapted to drive the second set of non-deactivatable exhaust valves and a sixth plurality of cams adapted to drive the third set of deactivatable exhaust valves, where the fifth plurality of cams have a fifth cam lobe profile and the sixth plurality of cams have a sixth cam lobe profile, where the fourth, fifth, and sixth cam lobe profiles are all different from one another. A third example of the line optionally includes one or both of the first and second examples, and further includes wherein each cylinder of the first plurality of cylinders is coupled to a corresponding intake valve of the first set of non-deactivatable intake valves and a corresponding exhaust valve of the first set of non-deactivatable exhaust valves, the intake valve and exhaust valve having a first amount of valve overlap per combustion cycle of their corresponding coupled cylinder; wherein each cylinder of the second plurality of cylinders is coupled to a corresponding intake valve of the second set of non-deactivatable intake valves and a corresponding exhaust valve of the second set of non-deactivatable exhaust valves, the intake valve and exhaust valve of the second set having a second amount of valve overlap per combustion cycle of their corresponding coupled cylinder; wherein each cylinder of the third plurality of cylinders is coupled to a corresponding intake valve of the third set of deactivatable intake valves and a corresponding exhaust valve of the third set of deactivatable exhaust valves, the intake valve and exhaust valve of the third set having a third amount of valve overlap per combustion cycle of their corresponding coupled cylinder; and wherein the second amount and third amount are a same amount of overlap, different from the first amount. A fourth example of the line optionally includes one or more or each of the first through third examples, and further includes wherein each valve of the second set of non-deactivatable intake valves and third set of deactivatable intake valves has a first, same opening rate and a first, same closing rate, and wherein each valve of the first set of non-deactivatable intake valves has a second, different opening rate and a second, different closing rate.

In another representation, an engine comprises: an intake camshaft and an exhaust camshaft; a first intake cam and a second intake cam coupled to the intake camshaft, the first intake cam having a different outer surface curvature (e.g., contour) than the second intake cam, the first intake cam adapted to drive a non-deactivatable intake valve of a first engine cylinder and the second intake cam adapted to drive a deactivatable intake valve of a second engine cylinder; a first exhaust cam and a second exhaust cam coupled to the exhaust camshaft, the first exhaust cam having a different outer surface curvature (e.g., contour) than the second exhaust cam, the first exhaust cam adapted to drive a non-deactivatable exhaust valve of the first engine cylinder and the second exhaust cam adapted to drive a deactivatable exhaust valve of the second engine cylinder; a transmission; and an electric machine selectably coupleable to the transmission via one or more clutches, the electric machine adapted to drive the transmission.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system, comprising:

a camshaft including first and second pluralities of cams, each cam of the first plurality of cams having a first cam lobe profile and each cam of the second plurality of cams having a different, second cam lobe profile;

a plurality of deactivatable cylinder valves driven by the first plurality of cams; and a plurality of non-deactivatable cylinder valves driven by the second plurality of cams;

wherein the first cam lobe profile includes a first base section, a first nose, and a first ramp section, the second cam lobe profile includes a second base section, a second nose, and a second ramp section, wherein a radius of the first base section is a same amount of length as a radius of the second base section, and wherein a length from a center of the first base section to the first nose in a radial direction of the first base section is a different amount than a length from a center of the second base section to the second nose in a radial direction of the second base section.

2. The system of claim 1, wherein each valve of the plurality of deactivatable cylinder valves is drivable from a fully closed position to a fully opened position by a corresponding cam of the first plurality of cams, each valve of the plurality of non-deactivatable cylinder valves is drivable from a fully closed position to a fully opened position by a corresponding cam of the second plurality of cams, and a lift amount of each valve of the plurality of deactivatable cylinder valves from the fully closed position to the fully opened position is a same amount as a lift amount of each valve of the plurality of non-deactivatable cylinder valves from the fully closed position to the fully opened position.

3. The system of claim 1, wherein the first ramp section tapers to the first nose and the first base section with a first curvature, wherein the second ramp section tapers to the second nose and the second base section with a second curvature, and wherein the first curvature is different than the second curvature.

4. The system of claim 1, wherein each location along an entire perimeter of the first ramp section is offset in a direction away from a rotational axis of the camshaft by a greater amount than each corresponding location of an entire perimeter of the second ramp section.

5. The system of claim 1, wherein each cam of the first plurality of cams includes the first nose positioned a first length from a rotational axis of the camshaft in a radial direction of the rotational axis, and each cam of the second plurality of cams includes the second nose positioned a different, second length from the rotational axis of the camshaft in the radial direction.

6. The system of claim 5, wherein the plurality of deactivatable cylinder valves driven by the first plurality of cams is adapted to have a first valve lift when driven by a cam lobe of each cam of the first plurality of cams, wherein the plurality of non-deactivatable cylinder valves driven by the second plurality of cams is adapted to have a second valve lift when driven by a cam lobe of each cam of the second plurality of cams, and wherein the first valve lift is equal to the second valve lift.

7. A system, comprising:

an intake camshaft and an exhaust camshaft;

a first intake cam and a second intake cam coupled to the intake camshaft, the first intake cam having a different cam lobe profile than the second intake cam, the first intake cam adapted to drive an intake valve of a first engine cylinder and the second intake cam adapted to drive an intake valve of a second engine cylinder; and a first exhaust cam and a second exhaust cam coupled to the exhaust camshaft, the first exhaust cam having a different cam lobe profile than the second exhaust cam, the first exhaust cam adapted to drive an exhaust valve of the first engine cylinder and the second exhaust cam adapted to drive an exhaust valve of the second engine cylinder;

wherein the first intake cam and the second intake cam have a different length from a nose of each cam to a base section of each cam along axis normal to the nose.

8. The system of claim 7, wherein the cam lobe profile of the first intake cam is different than a cam lobe profile of the first exhaust cam, and wherein the cam lobe profile of the second intake cam is different than a cam lobe profile of the second exhaust cam.

9. The system of claim 7, wherein a valve overlap of the intake valve and the exhaust valve of the first cylinder for a single combustion cycle of the first cylinder is a same amount as a valve overlap of the intake valve and the exhaust valve of the second cylinder for a single combustion cycle of the second cylinder.

10. The system of claim 7, wherein a valve opening rate of the intake valve of the first cylinder for a single combustion cycle of the first cylinder is the same as a valve opening rate of the intake valve of the second cylinder for a single combustion cycle of the second cylinder.

11. The system of claim 7, wherein a valve closing rate of the exhaust valve of the first cylinder for a single combustion cycle of the first cylinder is the same as a valve closing rate of the exhaust valve of the second cylinder for a single combustion cycle of the second cylinder.

12. The system of claim 7, wherein the first engine cylinder and the second engine cylinder are disposed within a first cylinder bank, and further comprising a second, opposing cylinder bank, the second cylinder bank including:

a second intake camshaft and a second exhaust camshaft;

a third intake cam and a fourth intake cam coupled to the second intake camshaft, the third intake cam having a same cam lobe profile as the first intake cam and the fourth intake cam having a same cam lobe profile as the second intake cam, the third intake cam adapted to drive an intake valve of a third engine cylinder disposed within the second cylinder bank and the fourth intake cam adapted to drive an intake valve of a fourth engine cylinder disposed within the second cylinder bank; and a third exhaust cam and a fourth exhaust cam coupled to the second exhaust camshaft, the third exhaust cam having a same cam lobe profile as the first exhaust cam and the fourth exhaust cam having a same cam lobe profile as the second exhaust cam, the third exhaust cam adapted to drive an exhaust valve of the third engine cylinder and the fourth exhaust cam adapted to drive an exhaust valve of the fourth engine cylinder.

13. The system of claim 7, wherein the intake valve and the exhaust valve of the first engine cylinder are non-deactivatable valves each driven by corresponding non-deactivatable rocker arms, and wherein the intake valve and the exhaust valve of the second engine cylinder are deactivatable valves each driven by corresponding deactivatable rocker arms.

14. A line of engines, comprising:

a first engine including a first plurality of cylinders having only a first set of non-deactivatable intake valves and a first camshaft including a first plurality of cams adapted to drive the first set of non-deactivatable intake valves, where all cams of the first plurality of cams have a same, first cam lobe profile; and a second engine including a second plurality of cylinders having a second set of non-deactivatable intake valves, a third plurality of cylinders having a third set of deactivatable intake valves, and a second camshaft including a second plurality of cams adapted to drive the second set of non-deactivatable intake valves and a third plurality of cams adapted to drive the third set of deactivatable intake valves, where the second plurality of cams has a second cam lobe profile and the third plurality of cams has a third cam lobe profile, where the first, second, and third cam lobe profiles are all different from one another, the first and second engines having a same engine block, wherein each cam of the first plurality of cams, second plurality of cams, and third plurality of cams has a different length from a nose of each cam to a base section of each cam along an axis normal to the nose.

15. The line of claim 14, wherein each cam of the first plurality of cams, second plurality of cams, and third plurality of cams has a different length from a nose of each cam to a base section of each cam along an axis normal to the nose.

16. The line of claim 14, wherein:

the first plurality of cylinders additionally includes only a first set of non-deactivatable exhaust valves and the first engine additionally includes a third camshaft including a fourth plurality of cams adapted to drive the first set of non-deactivatable exhaust valves, where all cams of the fourth plurality of cams have a same, fourth cam lobe profile; and a second set of non-deactivatable exhaust valves is coupled to the second plurality of cylinders, a third set of deactivatable exhaust valves is coupled to the third plurality of cylinders, and the second engine includes a fourth camshaft including a fifth plurality of cams adapted to drive the second set of non-deactivatable exhaust valves and a sixth plurality of cams adapted to drive the third set of deactivatable exhaust valves, where the fifth plurality of cams has a fifth cam lobe profile and the sixth plurality of cams has a sixth cam lobe profile, where the fourth, fifth, and sixth cam lobe profiles are all different from one another.

17. The line of claim 16, wherein each cylinder of the first plurality of cylinders is coupled to a corresponding intake valve of the first set of non-deactivatable intake valves and a corresponding exhaust valve of the first set of non-deactivatable exhaust valves, the intake valve and the exhaust valve of the first set having a first amount of valve overlap per combustion cycle of their corresponding coupled cylinder;

wherein each cylinder of the second plurality of cylinders is coupled to a corresponding intake valve of the second set of non-deactivatable intake valves and a corresponding exhaust valve of the second set of non-deactivatable exhaust valves, the intake valve and the exhaust valve of the second set having a second amount of valve overlap per combustion cycle of their corresponding coupled cylinder;

wherein each cylinder of the third plurality of cylinders is coupled to a corresponding intake valve of the third set of deactivatable intake valves and a corresponding exhaust valve of the third set of deactivatable exhaust valves, the intake valve and the exhaust valve of the third set having a third amount of valve overlap per combustion cycle of their corresponding coupled cylinder; and wherein the second amount and the third amount are a same amount of overlap, different from the first amount.

18. The line of claim 14, wherein each valve of the second set of non-deactivatable intake valves and the third set of deactivatable intake valves has a first, same opening rate and a first, same closing rate, and wherein each valve of the first set of non-deactivatable intake valves has a second, different opening rate and a second, different closing rate.

* * * * *